US009933741B2

(12) United States Patent
Iwasawa

(10) Patent No.: US 9,933,741 B2
(45) Date of Patent: Apr. 3, 2018

(54) CONNECTION DEVICE AND IMAGE FORMING APPARATUS

(71) Applicant: CANON KABUSHIKI KAISHA, Tokyo (JP)

(72) Inventor: Ryo Iwasawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/140,162

(22) Filed: Apr. 27, 2016

(65) Prior Publication Data

US 2016/0320734 A1 Nov. 3, 2016

(30) Foreign Application Priority Data

Apr. 30, 2015 (JP) ..... 2015-093500

(51) Int. Cl.
*G03G 15/00* (2006.01)
*G03G 21/16* (2006.01)

(52) U.S. Cl.
CPC ..... *G03G 15/6502* (2013.01); *G03G 21/1628* (2013.01); *G03G 21/1652* (2013.01); *G03G 21/1695* (2013.01)

(58) Field of Classification Search
CPC ..... G03G 15/80; G03G 2215/00978; G03G 2215/00016; G03G 15/6502; G03G 21/1628; G03G 21/1652; G03G 21/1695
See application file for complete search history.

(56) References Cited

U.S. PATENT DOCUMENTS

2004/0109713 A1* 6/2004 Ozawa ..... G03G 15/6502 399/388
2005/0014392 A1* 1/2005 Liu ..... H01R 31/06 439/22
2006/0083564 A1* 4/2006 Yazawa ..... B41J 29/023 399/363
2007/0054508 A1* 3/2007 Cheng ..... H01R 35/04 439/13
2009/0324263 A1* 12/2009 Shimizu ..... B65H 1/04 399/38

FOREIGN PATENT DOCUMENTS

JP S62-33661 A 2/1987
JP 2012-103648 A 5/2012
JP 2013-97018 A 5/2013

OTHER PUBLICATIONS

JP 2013-97018 Machine Translation.*

* cited by examiner

*Primary Examiner* — David Banh
(74) *Attorney, Agent, or Firm* — Canon U.S.A., Inc. IP Division

(57) ABSTRACT

A printer main body is mounted on a sheet feeding option, and the sheet feeding option is electrically connected to the mounted printer main body. The sheet feeding option has a connecting member configured to turn on a turn axis. The connecting member is disposed at a position closer to one end than the other end of the printer main body in a direction intersecting a direction of the turn axis, and turns from a connected position electrically connected to the printer main body only toward the one end.

15 Claims, 21 Drawing Sheets

CONNECTION DEVICE AND IMAGE FORMING APPARATUS

BACKGROUND OF THE INVENTION

Field of the Invention

The present invention relates to a connection device to be connected to an electric apparatus, such as a printer, a copying machine, or a facsimile, which forms an image on a recording material, and to an image forming apparatus.

Description of the Related Art

There has hitherto been a connection device, such as a recording-material conveying device, which can be disposed under and connected to an electric apparatus such as an image forming apparatus or a recording-material conveying device. A connection device can also be disposed under and connected to another connection device.

In a configuration disclosed in Japanese Patent Laid-Open No. 2012-103648, an image forming apparatus serving as an electric apparatus is mounted on a sheet feeding option serving as a connection device to connect a pair of connecting portions provided in an upper part of the sheet feeding option and a bottom part of the image forming apparatus. The image forming apparatus and the sheet feeding option are thereby electrically connected.

The user sometimes removes the electric apparatus from the connection device, for example, for the purposes of maintenance, such as part replacement and cleaning, of the connection device and movement of the installation place of the connection device. At this time, it is ideal for the user to move and lift the electric apparatus in the direction vertical to the connection device.

SUMMARY OF THE INVENTION

According to a first aspect of the present invention, there is provided a connection device on or under which an electric apparatus is mounted and which is electrically connected to the mounted electric apparatus, the connection device including, a connecting member provided turnably on a turn axis to be electrically connected to the electric apparatus, wherein the connecting member is disposed at a position closer to one end than the other end of the connection device in a direction intersecting a direction of the turn axis, and turns from a connected position electrically connected to the electric apparatus only toward the one end.

According to a second aspect of the present invention, there is provided a connection device on or under which an electric apparatus is mounted and which is electrically connected to the mounted electric apparatus, the connection device including, a connecting member provided turnably on a turn axis to be electrically connected to the electric apparatus, wherein the connecting member is disposed at a position closer to one end than the other end of the connection device in a direction intersecting a direction of the turn axis, and a turn amount by which the connecting member turns from a connected position electrically connected to the electric apparatus to the one end is more than a turn amount by which the connecting member turns from the connected position to the other end.

According to a third aspect of the present invention, there is provided an image forming apparatus including, an apparatus main body having an image forming unit configured to form a toner image on a recording material, and a connection device disposed under the apparatus main body to be electrically connected to the apparatus main body, wherein the connection device includes a feeding unit configured to feed the recording material to the image forming unit, and a connecting member configured to turn on a turn axis and to be electrically connected to the apparatus main body, and wherein the connecting member is disposed at a position closer to one end than the other end of the connection device in a direction intersecting a direction of the turn axis and turns from a connected position electrically connected to the electric apparatus only toward the one end.

Further features of the present invention will become apparent from the following description of exemplary embodiments with reference to the attached drawings.

DESCRIPTION OF THE EMBODIMENTS

First Embodiment

A first embodiment of the present invention will be described below. In the description of the first embodiment, an image forming apparatus formed by a laser beam printer is used as an example of an electric apparatus.

Figure 1:
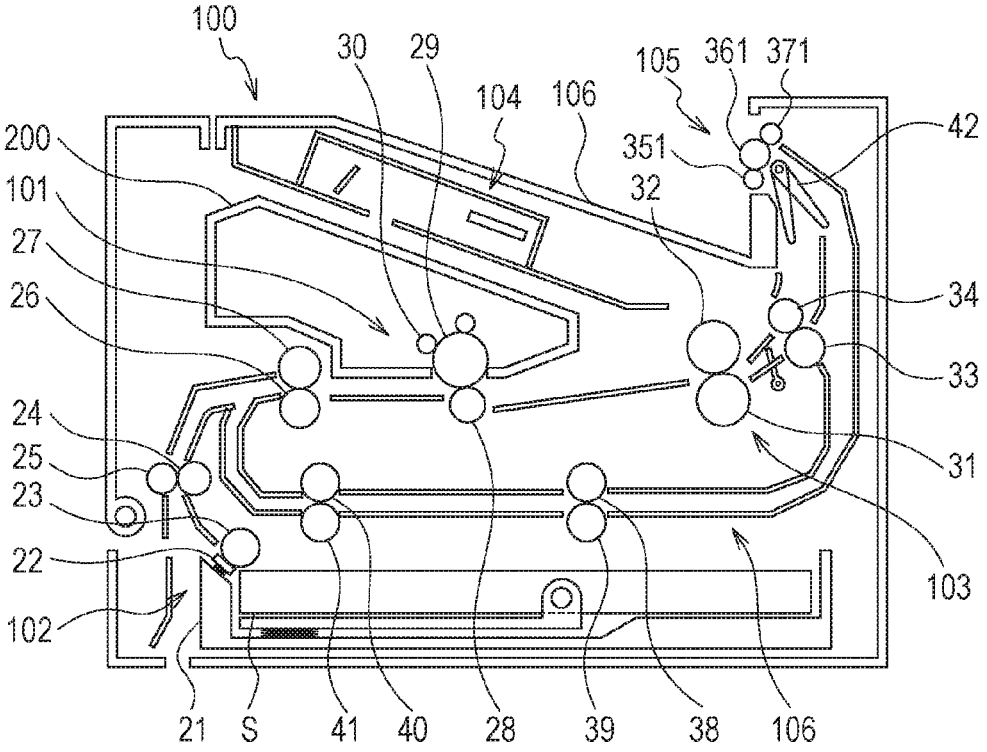
FIG. 1 is a schematic cross-sectional view of an image forming apparatus according to a first embodiment.

First, a configuration and an image forming process of an image forming apparatus 100 formed by a laser beam printer will be described with reference to FIGS. 1 and 2. FIG. 1 is a schematic cross-sectional view of the image forming apparatus 100. As illustrated in FIG. 1, the image forming apparatus 100 includes an image forming unit 101, a sheet feeding device 102, a laser scanner unit 104, a fixing device 103, an output duplex conveying unit 105, and an output tray 106. The sheet feeding device 102 includes a feeding cassette 21, a separating pad 22, and a sheet feeding roller 23, and feeds stacked sheets S by the sheet feeding roller 23. After that, a fed sheet S is further conveyed downstream by a feeding conveying roller pair composed of a sheet feeding conveying roller 24 and a sheet feeding conveying idler roller 25. The sheet feeding device 102 further includes a registration roller pair composed of a registration roller 26 and a registration idler roller 27 that temporarily stop the sheet S to register a toner image and the sheet S. The sheet S conveyed by the sheet feeding conveying roller pair is registered by the registration roller pair, and is then conveyed to the image forming unit 101.

The image forming unit 101 includes a process cartridge 200 removably attached to the image forming apparatus 100. Inside the process cartridge 200, a photoconductive drum. 29 is provided as an image bearing member. The image forming unit 101 further includes a transfer roller 28 disposed opposed to the photoconductive drum 29. A surface of the photoconductive drum 29 uniformly charged by a charging device is irradiated with laser light from the laser scanner unit 104 according to image information in response to a print command, and an electrostatic latent image is thereby formed on the surface of the photoconductive drum 29. By developing the electrostatic latent image by a developing device 30, a toner image is formed on the surface of the photoconductive drum 29. The toner image formed on the surface of the photoconductive drum 29 is transferred onto a sheet S sent to a nip between the photoconductive drum 29 and the transfer roller 28 by the registration roller pair, and is then conveyed to the fixing device 103.

The fixing device 103 includes a heating roller 32, a pressing roller 31 in pressure contact with the heating roller 32, a fixing conveying roller 33, and a fixing conveying idler roller 34. The sheet S sent to the fixing device 103 is led to a nip between the heating roller 32 and the pressing roller 31 in pressure contact therewith in the fixing device 103. At this time, the toner image is fixed on the sheet S by heat and pressure. After that, the sheet S is born by a fixing conveying roller pair composed of the fixing conveying roller 33 and the fixing conveying idler roller 34, and is conveyed to the output duplex conveying unit 105. The output duplex conveying unit 105 includes a triple roller having a sheet output and inverting function and composed of an output driven roller 351, an output driving roller 361, and an inverting driven roller 371, and a flapper 42 for switching the conveying path. The output duplex conveying unit 105 selects an output operation or an inverting operation according to a print command.

In the output operation, the sheet S is output and stacked on the output tray 106 as it is. In the inverting operation, the conveying direction of the sheet S is reversed at a predetermined timing, and the sheet S is conveyed to an inverting conveying path. After that, the sheet S is refed by a duplex conveying roller pair composed of a duplex conveying roller 39 and a duplex conveying idler roller 38 and a refeeding roller pair composed of a refeeding roller 41 and a refeeding idler roller 40. The refed sheet S passes through the image forming unit 101 and the fixing device 103 again, and a second surface of the sheet S is printed similarly to the first surface. After that, the sheet S is output and stacked on the output tray 106 by the output duplex conveying unit 105.

Sheet Feeding Option 301

A sheet feeding option 301 can be connected as an optional device to a printer main body 300 in order to increase the accommodating capacity for sheets S. When the sheet feeding option 301 is not connected, the image forming apparatus 100 is composed only of the printer main body 300. When the sheet feeding option 301 is connected, the image forming apparatus 100 is composed of the printer main body 300 and the sheet feeding option 301. FIG. 2 is a schematic cross-sectional view of the image forming apparatus 100 in a state in which the sheet feeding option 301 serving as a connection device is connected to the printer main body 300. The sheet feeding option 301 includes an accommodation section 305 that accommodates sheets S, a sheet feeding conveying section 302 having the same sheet feeding function as that of the above-described sheet feeding device 102 in the printer main body 300, and a conveying roller pair 43 that conveys the sheets S. When the sheet feeding option 301 is used, the printer main body 300 is placed (mounted) on an upper side of the used sheet feeding option 301. A sheet S fed from the accommodation section 305 by the sheet feeding conveying section 302 is conveyed toward the printer main body 300 by the conveying roller pair 43. After entering the printer main body 300, the sheet S passes through the conveying path inside the printer main body 300, is delivered to the feeding conveying roller pair composed of the rollers 24 and 25, and is thereby conveyed downstream. Conveyance on the downstream, side of the feeding conveying roller pair of the rollers 24 and 25 is the same as the above-described one.

In the first embodiment, a plurality of sheet feeding options 301 can be used by being connected to the printer main body 300. When a plurality of sheet feeding options 301 are used, the used sheet feeding options 301 are stacked, and the printer main body 300 is placed on the uppermost sheet feeding option 301. When a sheet is fed from the lowermost sheet feeding option 301, the fed sheet S is conveyed by a conveying roller pair 43, passes through a conveying path in the next upper sheet feeding option 301, and is delivered to a conveying roller pair 43 in the sheet feeding option 301. Conveyance on the downstream side of the conveying roller pair 43 is the same as the above-described one.

Connection Mechanism of Sheet Feeding Option and Printer Main Body

Figure 3:
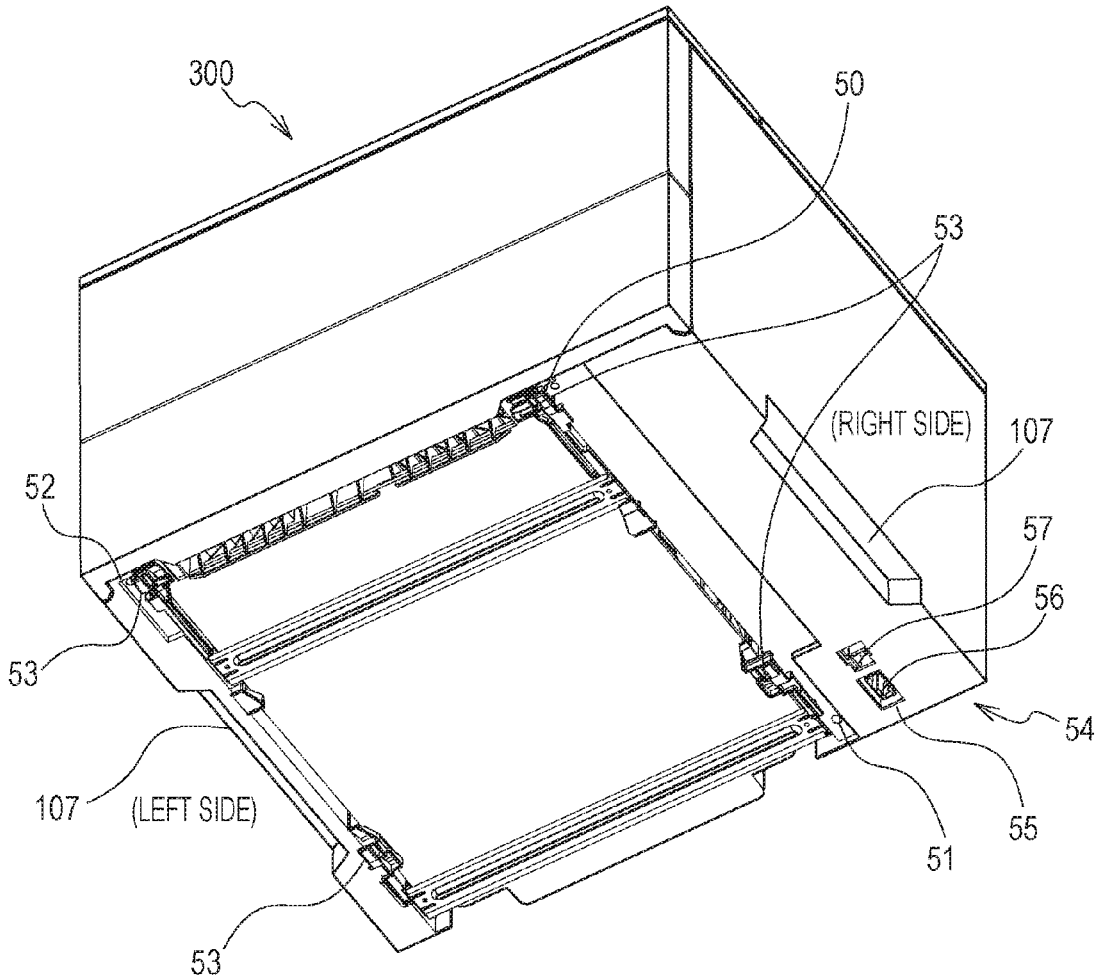
FIG. 3 is a schematic perspective view of the printer main body according to the first embodiment.

Next, a connection mechanism between the sheet feeding option 301 and the printer main body 300 will be described in detail with reference to FIGS. 3, 4A, 4B, 5A and 5B. For simplicity, inner components and outer components unnecessary for explanation are omitted. FIG. 3 is a schematic perspective view of the printer main body 300 from the lower surface side. The lower surface of the printer main body 300 is provided with a first positioning hole 50, a second positioning hole 51, a third positioning hole 52, a plurality of grounding legs 53, and a first connecting member 54. The first connecting member 54 includes a first holder 55 and a first connector 56, and the first holder 55 has a rough guide hole 57. Handles 107 to be gripped by the user to lift the printer main body 300 are provided only on the right and left sides of the printer main body 300.

Figure 4A:
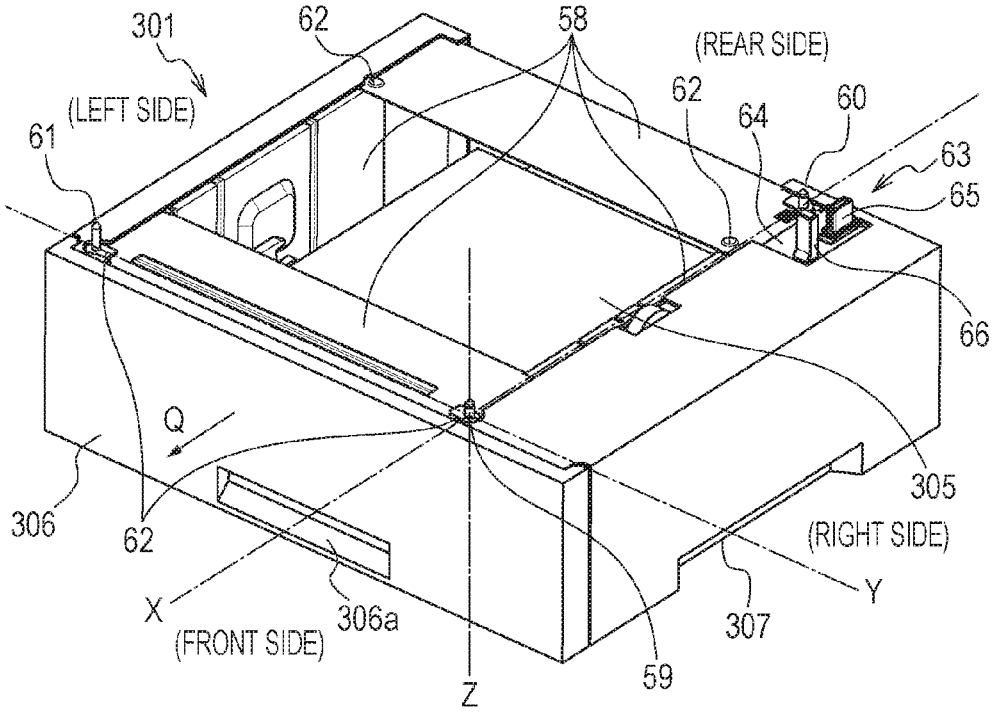
FIGS. 4A and 4B are schematic perspective views of a sheet feeding option according to the first embodiment.

FIG. 4A is a schematic perspective view of the sheet feeding option 301 from the upper surface side. As illustrated in FIG. 4A, the sheet feeding option 301 is constituted by a frame 58 composed of a plurality of components, inner components, and outer components. The upper surface of the sheet feeding option 301 is provided with a first positioning pin 59, a second positioning pin 60, a third positioning pin 61, a plurality of seat faces 62, and a second connecting member 63. The second connecting member 63 includes a second holder 64 and a second connector 65, and the second holder 64 has a rough guide (projection) 66. The sheet feeding option 301 includes an opening and closing part 306 that opens in a Q-direction (opening direction) parallel to the X-axis in order for the user to supply and store sheets S in the accommodation section 305. The opening and closing part 306 has a handle portion 306*a* to be gripped by the user to move the opening and closing part 306 in the Q-direction (opening direction).

Figure 4B:
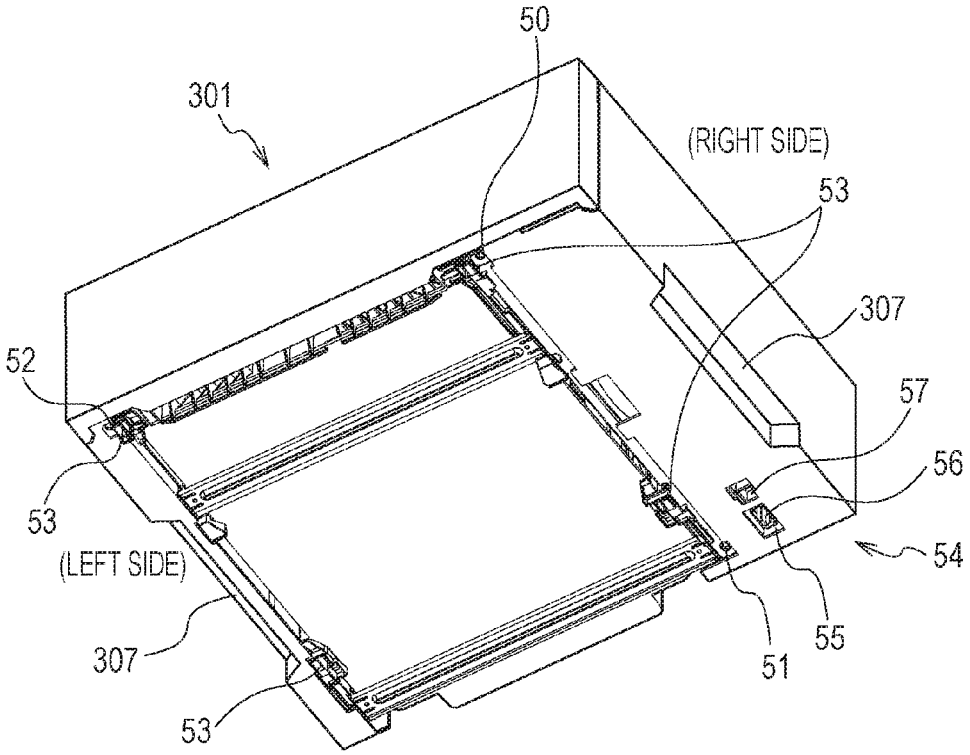

FIG. 4B is a schematic perspective view of the sheet feeding option 301 from the lower surface side. As illustrated in FIG. 4B, the lower surface of the sheet feeding option 301 is provided with a first positioning hole 50, a second positioning hole 51, a plurality of grounding legs 53, and a first connecting member 54, similarly to the printer main body 300. Handles 307 to be gripped by the user to lift the sheet feeding option 301 are provided only on the right and left sides of the sheet feeding option 301.

A description will be given of the definition of reference axes in the first embodiment illustrated in FIG. 4A. A plane passing through the plural seat faces 62 provided on the sheet feeding option 301 is defined as a Z-reference surface such that Z=0, and a straight line extending parallel to the Z-reference surface and passing through the center of the first positioning pin 59 and the center of the second positioning pin 60 is defined as an X-axis. The X-axis is parallel to the Q-direction. Further, a straight line extending parallel to the Z-reference surface and orthogonally to the X-axis and passing through the center of the first positioning pin 59 is defined as a Y-axis. A straight line extending perpendicularly to the Z-reference surface and passing through the center of the first positioning pin 59 is defined as a Z-axis. A direction parallel to the X-axis is defined as an X-direction, a direction parallel to the Y-axis is defined as a Y-direction, and a direction parallel to the Z-axis is defined as a Z-direction. When the sheet feeding option 301 is disposed on a horizontal installation surface, the Z-reference surface is a horizontal surface.

When the sheet feeding option 301 is viewed from directly above, a side where the handle portion 306*a* is disposed is defined as a front side, and a side opposite from the front side in the Q-direction is defined as a rear side. A left hand side is defined as a left side and a right hand side is defined as a right side when the user faces the front side of the sheet feeding option 301. In a state in which the printer main body 300 is positioned and mounted on the sheet feeding option 301, front, rear, left, and right sides of the printer main body 300 are the same as those of the sheet feeding option 301.

Figure 5A:
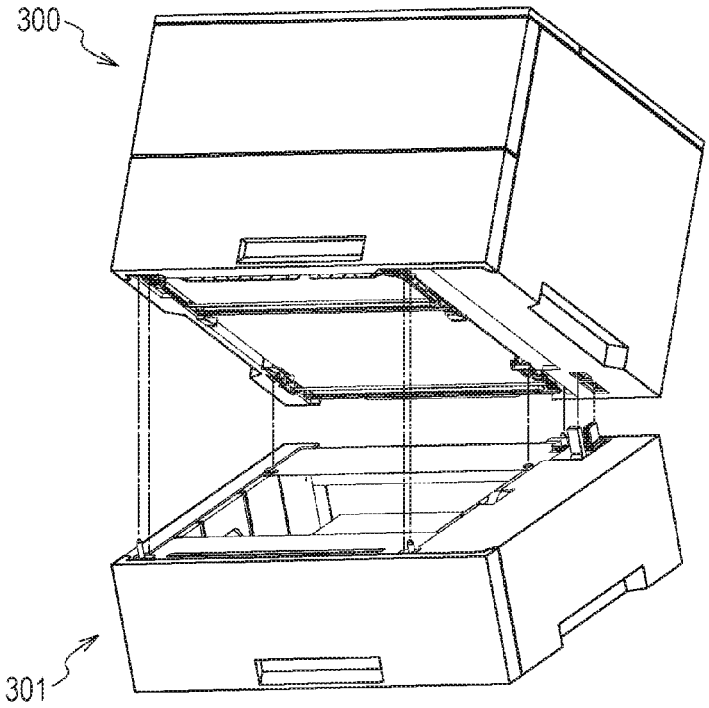
FIG. 5A is a schematic perspective view illustrating the relationship between the sheet feeding option and the printer main body in the first embodiment.

Next, the positional engagement relationship when the printer main body 300 and the sheet feeding option 301 are connected will be described with reference to FIGS. 5A and 5B. FIG. 5A is a schematic perspective view illustrating the positional engagement relationship when the sheet feeding option 301 is connected to the printer main body 300. At this time, the first positioning hole 50 and the first positioning pin 59 are engaged with each other, and the second positioning hole 51 and the second positioning pin 60 are engaged with each other. The grounding legs 53 are in contact with the seat faces 62. The second connector 65 and the first connector 56 are engaged with each other, and the rough guide hole 57 and the rough guide 66 are fitted each other.

Figure 5B:
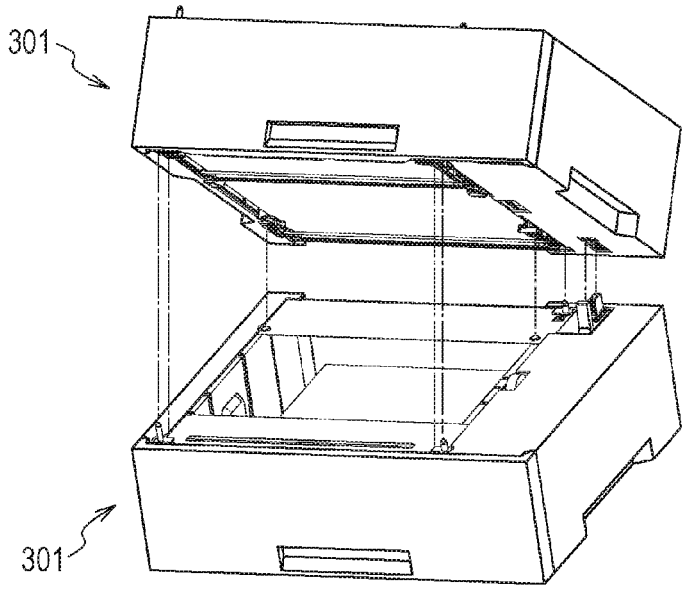
FIG. 5B is a schematic perspective view illustrating a connected state of sheet feeding options in the first embodiment.

FIG. 5B is a schematic perspective view illustrating the positional engagement relationship when sheet feeding options 301 are connected. At this time, the first positioning hole 50 of the upper sheet feeding option 301 is engaged with the first positioning pin 59 of the lower sheet feeding option 301, and the second positioning hole 51 of the upper sheet feeding option 301 is engaged with the second positioning pin 60 of the lower sheet feeding option 301. The grounding legs 53 of the upper sheet feeding option 301 are grounded on the seat faces 62 of the lower sheet feeding option 301. The rough guide hole 57 of the upper sheet feeding option 301 is engaged with the rough guide 66 of the lower sheet feeding option 301, and the first connector 56 of the upper sheet feeding option 301 is engaged with the second connector 65 of the lower sheet feeding option 301.

By the above-described engagements of the connectors and the positioning pins, the printer main body 300 and the sheet feeding option 301 or the sheet feeding option 301 and the sheet feeding option 301 are properly positioned and electrically connected. Specifically, the positional relationships in the X-direction and the Y-direction are determined by the first positioning pin 59 and the second positioning pin 60, and the positional relationship in the Z-direction is determined by the seat faces 62. Connections of the printer main body 300 and the sheet feeding option 301 or the sheet feeding option 301 and the sheet feeding option 301 in proper positional relationships allow accurate conveyance control and driving transmission. By engagement of the first connector 56 and the second connector 65, the printer main body 300 and the upper sheet feeding option 301 and the upper sheet feeding option 301 and the lower sheet feeding option 301 are brought into an electrically connected state (power application state). This allows driving control in the sheet feeding options 301 and signal transmission and receiving between each of the sheet feeding options 301 and the printer main body 300.

Next, the structures near the second connecting member 63 and the first connecting member 54 will be described in detail with reference to FIGS. 6 to 9A and 9B. Inner components and outer components unnecessary for explanation are omitted.

Structure of Second Connecting Member 63

Figure 6:
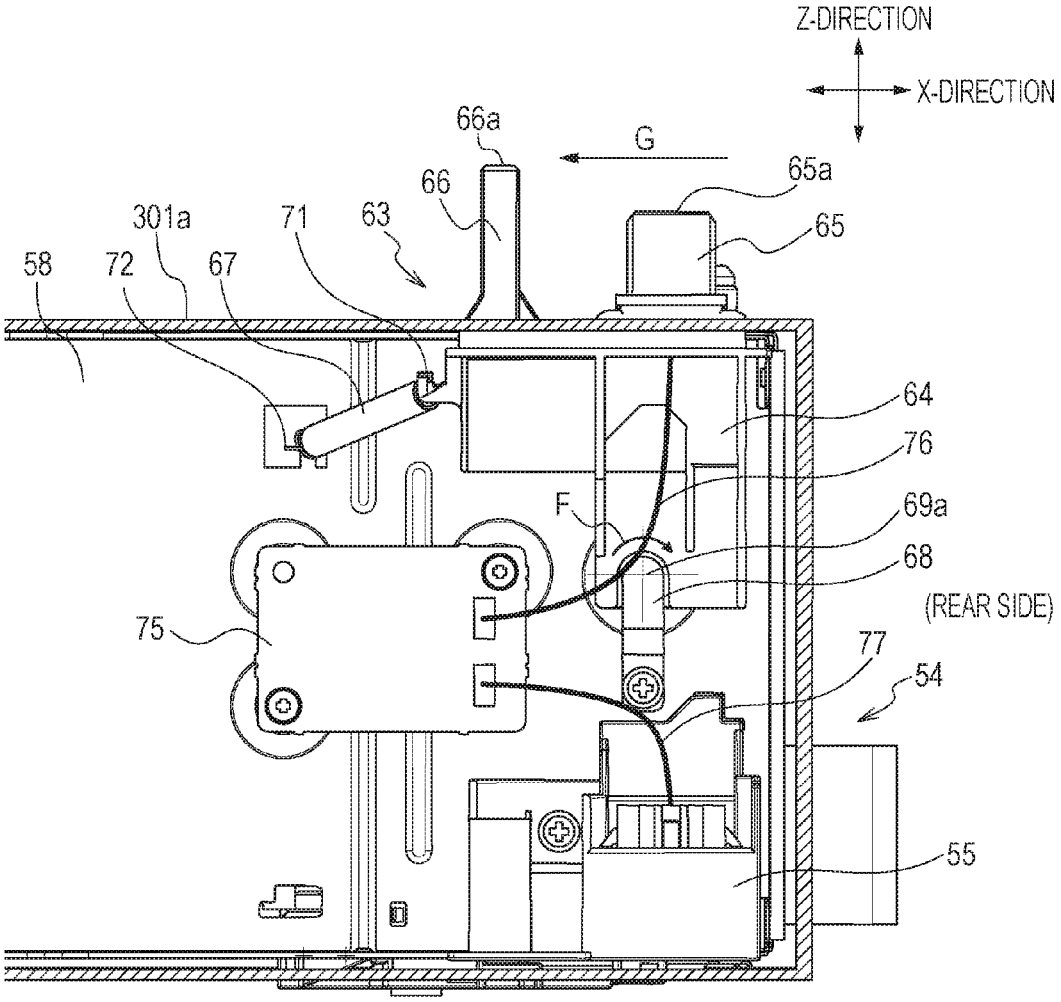
FIG. 6 is a schematic cross-sectional view of a second drawer connecting member according to the first embodiment.

First, the second connecting member 63 will be described. FIG. 6 is a schematic sectional view of a section near the second connecting member 63 of the sheet feeding option 301. In the X-direction, the second connecting member 63 is disposed at a position closer to a rear end portion (one end) than a front end portion (other end) of an upper part 301*a* of the sheet feeding option 301. The second connecting member 63 includes a second connector 65, a second holder 64, a spring 67, and a pressing member 68. The second holder 64 is supported and fixed in the Y-direction while being held between the frame 58 and the pressing member 68 fixed to the frame 58. The second connector 65 is fixed to the second holder 64. An upper surface 66*a* of the rough guide 66 is located at a position higher (protruding) than an upper surface 65*a* of the second connector 65 fixed to the second holder 64 in the Z-direction (upward direction). The rough guide 66 can contact with a rough guide hole 57 in a sheet feeding option 301 having a first connector 56 (to be described later) to be connected to the second connector 65. The rough guide 66 is disposed at a position farther from the rear end portion of the upper part 301*a* of the sheet feeding option 301 than the second connector 65.

Figure 7A:
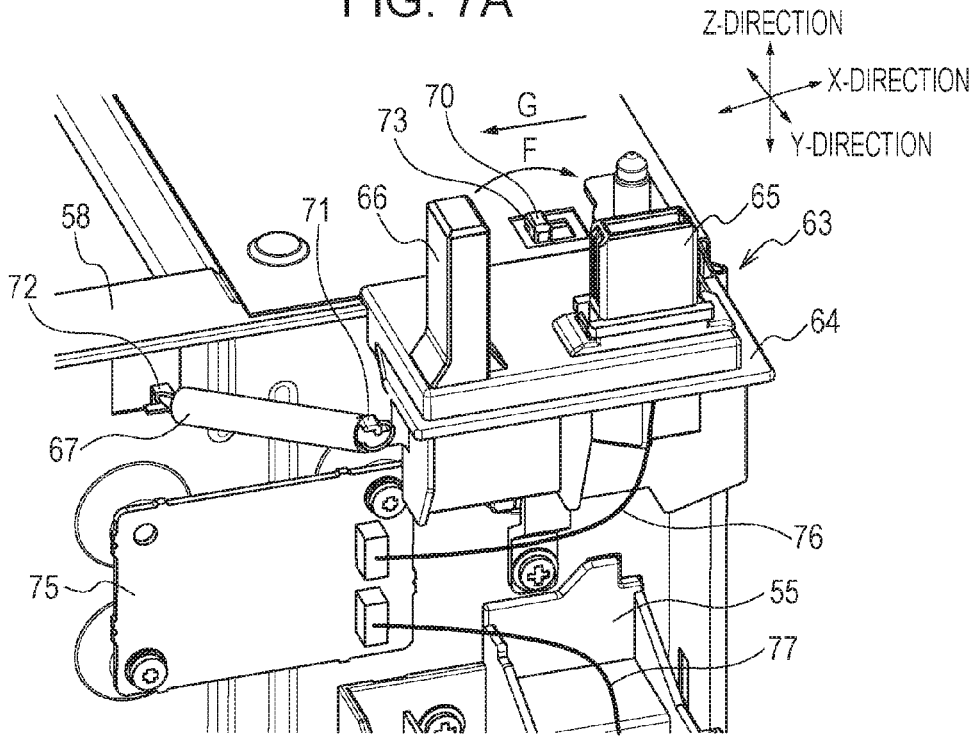
FIGS. 7A and 7B are schematic perspective views of the second drawer connecting member of the first embodiment.
Figure 7B:
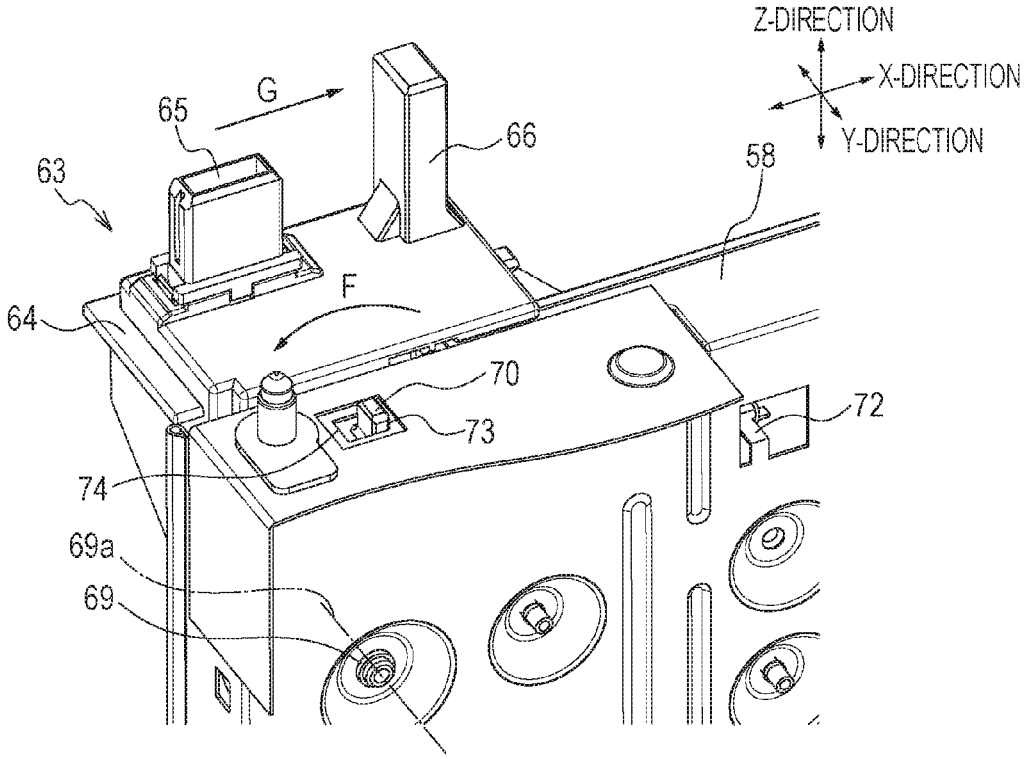

FIG. 7A is a schematic perspective view of the section near the second connecting member 63. FIG. 7B is a schematic perspective view from a side opposite from the side of FIG. 7A. The second holder 64 includes the rough guide 66, a pivot center portion 69, an abutting portion 70, and a spring hook portion 71. The pivot center portion 69 is fitted in the frame 58. The second holder 64 is fixed in the Y-direction and the Z-direction, and is supported turnably on the pivot center portion 69 around a pivot axis 69*a*. The pivot axis 69*a* intersects the X-direction (in the first embodiment, the axial direction of the pivot axis 69*a* is orthogonal to the X-direction and parallel to the Y-direction). Hence, the second connector 65 and the rough guide 66 provided in the second holder 64 can turn together in an F-direction. One end of the spring 67 is attached to the spring hook portion 71, and the other end is attached to a spring hook portion 72 on the frame 58 of the sheet feeding option 301, Thus, the second holder 64 is constantly biased in a G-direction by force received from the spring 67. The biased second holder 64 remains stationary at a position where the abutting portion 70 of the second holder 64 abuts on a second restricting portion 73.

Figure 8:
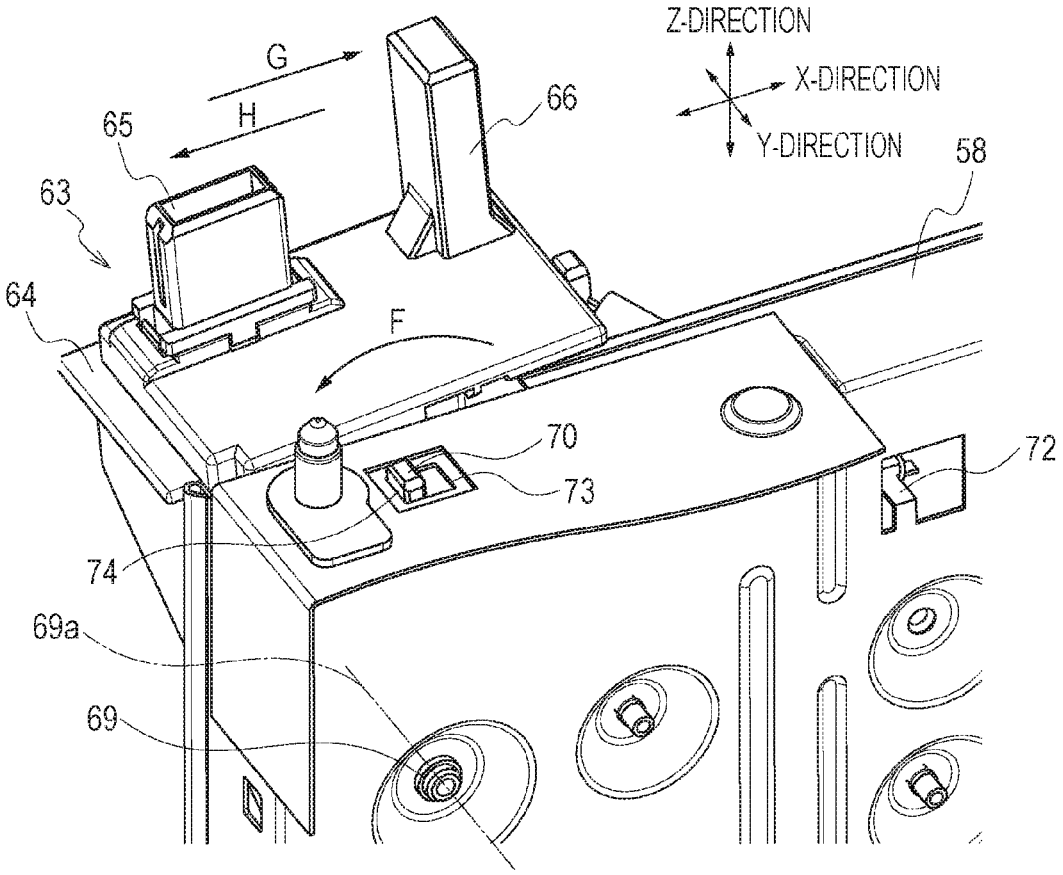
FIG. 8 is a schematic perspective view of a second drawer holder in the first embodiment.

FIG. 8 is a schematic perspective view illustrating a state in which the second holder 64 is turned. When the second holder 64 is pushed in an H-direction opposite from, the G-direction against the biasing force of the spring 67, it can turn on the pivot axis 69*a* in the F-direction. At this time, the second holder 64 can turn rearward, by a predetermined turn amount until the abutting portion 70 abuts on a first restricting portion 74. When the force applied in the H-direction is removed, the second holder 64 is returned and stopped by the spring 67 at the position where the abutting portion 70 of the second holder 64 abuts on the second, restricting portion 73.

As illustrated in FIG. 6, the sheet feeding option 301 includes an electric substrate 75 supported by the frame 58. The second connector 65 is electrically connected, to the electric substrate 75 by a bundled wire 76, and the first connector 56 is electrically connected to the electric substrate 75 by a bundled wire 77. Thus, when the printer main body 300 and a plurality of sheet feeding options 301 are stacked, electric substrates 75 in the sheet feeding options 301 are electrically connected, to an unillustrated electric substrate provided in the printer main body 300. This allows driving control on the plural sheet feeding options 301.

Structure of First Connecting Member 54

Figure 9A:
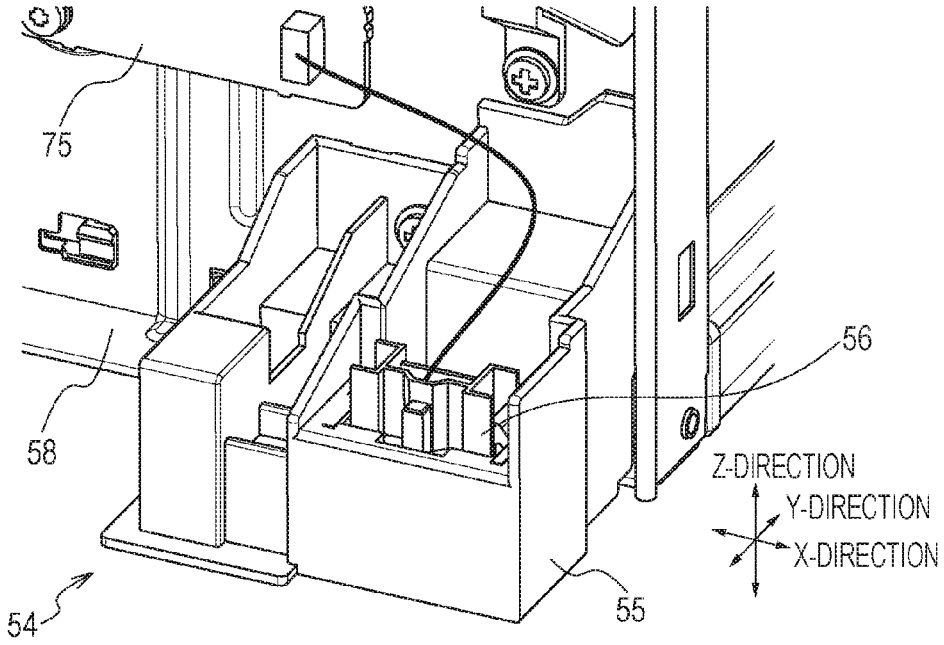
FIGS. 9A and 9B are schematic perspective views of a first drawer connecting member according to the first embodiment.
Figure 9B:
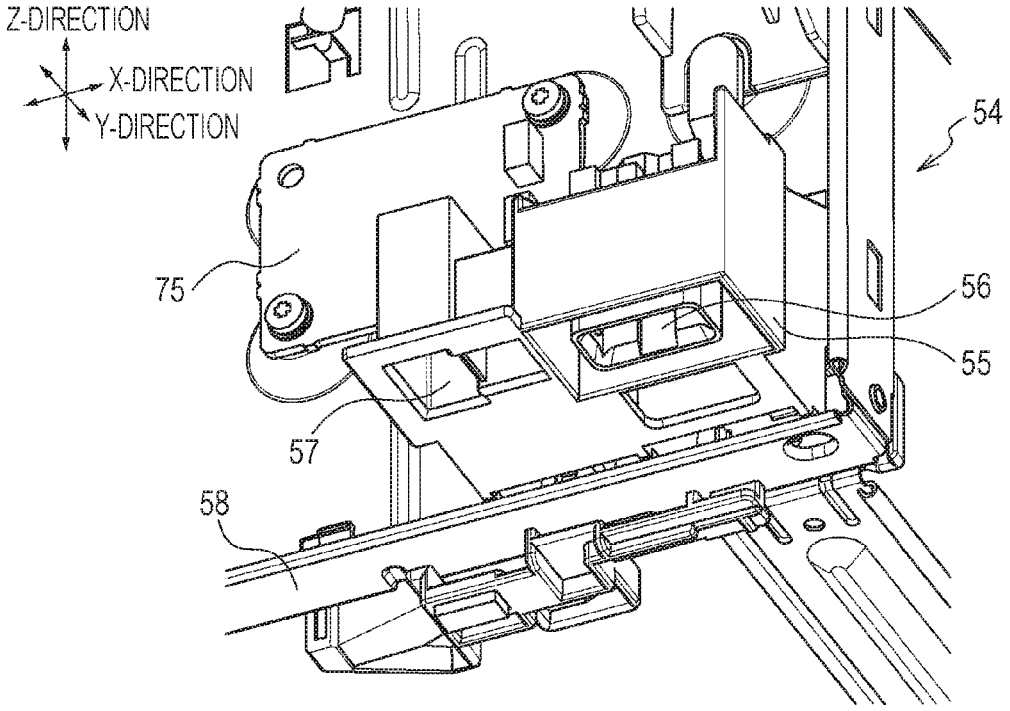

Next, the first connecting member 54 will be described. FIGS. 9A and 9B are schematic perspective views of a section near the first connecting member 54 in the sheet feeding option 301. The first connecting member 54 is composed of a first connector 56 and a first holder 55. In the X-direction, the first connecting member 54 is disposed at a position closer to the rear side than the front side of the sheet feeding option 301. The first holder 55 is fixed to the frame 58. The first connector 56 is supported by the first holder 55, but is not completely fixed. The first connector 56 is supported by the first holder 55 with a gap therebetween in the X-direction and the Y-direction. However, the first connector 56 is supported with no gap in the Z-direction. The first holder 55 has a rough guide hole 57. While the structure of the first connecting member 54 in the sheet feeding option 301 is illustrated in FIGS. 9A and 9B, the first connecting member 54 provided in the printer main body 300 has the same structure.

Next, cases in which the printer main body 300 and the sheet feeding option 301 are connected and disconnected (removed) will be described with reference to FIGS. 10A to 10D and 11A to 11D. FIGS. 10A, 10C, 11A, and 11C are perspective views, and FIGS. 10B, 10D, 11B, and 11D are cross-sectional views of a section near the first and second connectors 56 and 65.

Connection of Printer Main Body 300 and Sheet Feeding Option 301

Figure 10A:
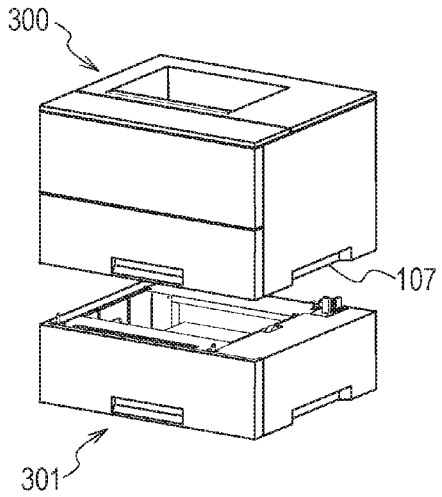
FIG. 10A is a schematic perspective view illustrating the relationship between the sheet feeding option and the printer main body of the first embodiment.
Figure 10B:
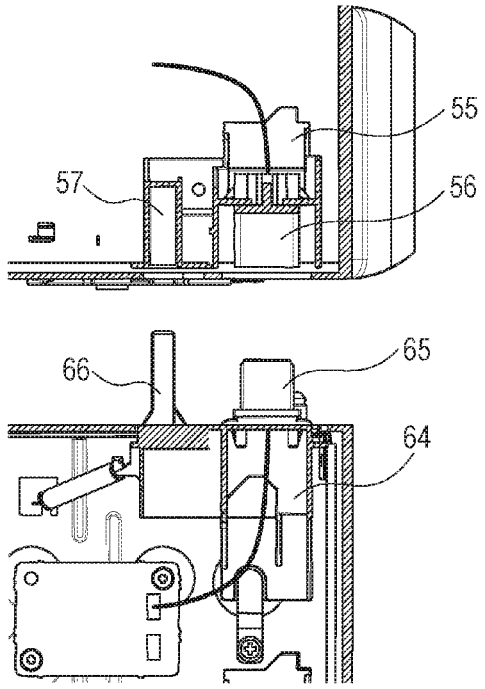
FIG. 10B is a schematic cross-sectional view of the drawer connecting members of the first embodiment.

FIG. 10A is a schematic perspective view illustrating a connection track of the apparatus when the user lowers the printer main body 300 straight in the Z-direction to place the printer main body 300 onto the sheet feeding option 301, and FIG. 10B is a schematic cross-sectional view of a section near a drawer connecting member. To add a sheet feeding option 301 to the printer main body 300, the user lifts up the printer main body 300 and supports the printer main body 300 by the sheet feeding option 301 while gripping the handles 107 of the printer main body 300, and places the printer main body 300 on the sheet feeding option 301. At this time, the printer main body 300 and the sheet feeding option 301 need to be registered in the X-direction and the Y-direction in order to be connected properly. As illustrated in FIGS. 10A and 10B, the user first lowers the printer main body 300 toward the sheet feeding option 301 while carrying the printer main body 300. Since the rough guide 66 provided in the sheet feeding option 301 is located at the highest position in the Z-direction, it first comes into contact with the printer main body 300.

Figure 10C:
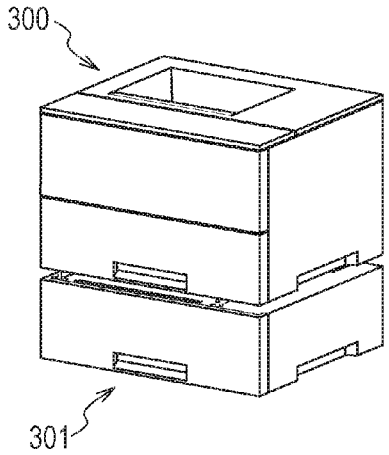
FIG. 10C is a schematic perspective view illustrating the relationship between the sheet feeding option and the printer main body of the first embodiment.
Figure 10D:
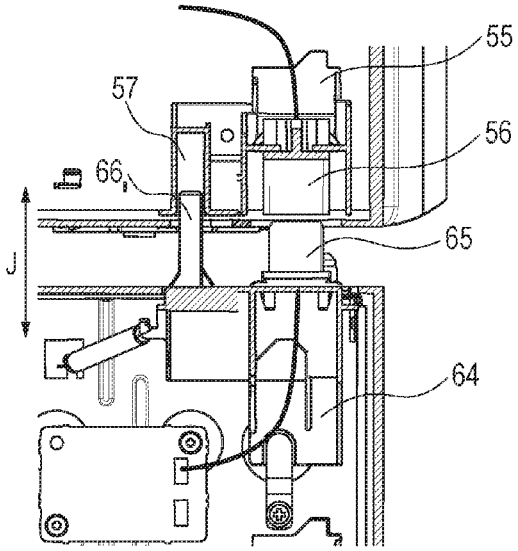
FIG. 10D is a schematic cross-sectional view of the drawer connecting members of the first embodiment.
Figure 11A:
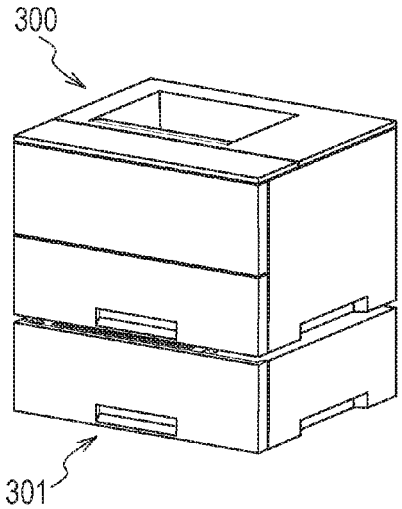
FIG. 11A is a schematic perspective view illustrating the relationship between the sheet feeding option and the printer main body of the first embodiment.
Figure 11B:
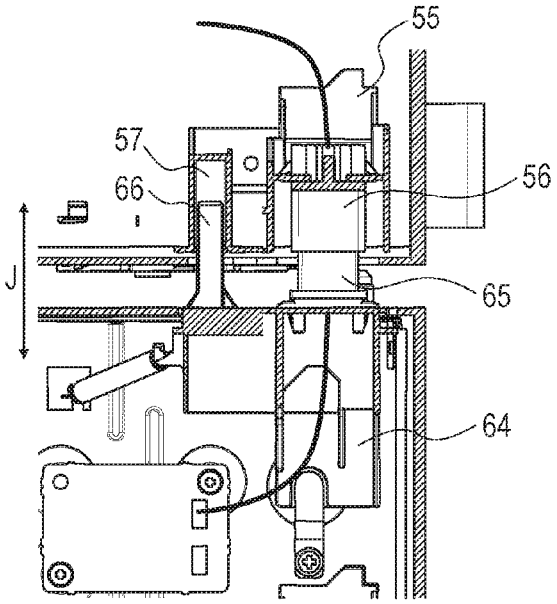
FIG. 11B is a schematic cross-sectional view of the drawer connecting members of the first embodiment.
Figure 11C:
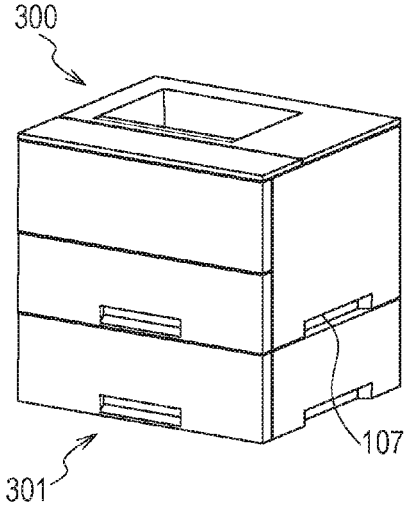
FIG. 11C is a schematic perspective view illustrating the relationship between the sheet feeding option and the printer main body of the first embodiment.
Figure 11D:
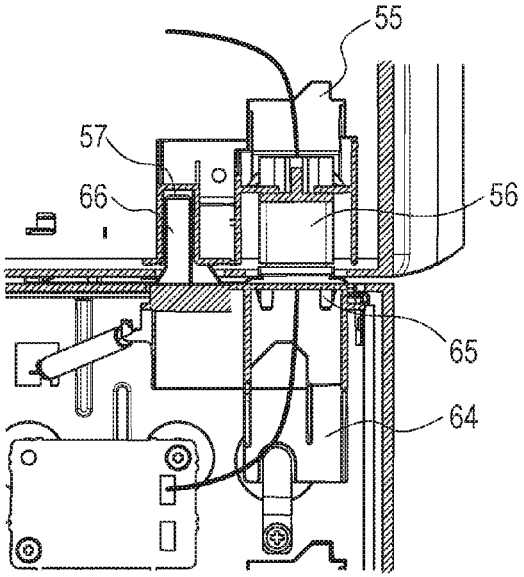
FIG. 11D is a schematic cross-sectional view of the drawer connecting members of the first embodiment.

When the user adjusts the position of the printer main body 300 and the rough guide 66 and the rough guide hole 57 of the printer main body 300 are registered in the X-direction and the Y-direction, the rough guide 66 and the rough guide hole 57 start to engage with each other. This engagement is illustrated in FIGS. 10C and 10D. The proper positional relationship of the printer main body 300 and the sheet feeding option 301 for connection can be thereby substantially maintained. When the printer main body 300 is further lowered, as illustrated in FIGS. 11A and 11B, the first connector 56 of the printer main body 300 and the second connector 65 of the sheet feeding option 301 come into contact with each other and start to engage with each other. At this time, since the rough guide 66 and the rough guide hole 57 are already engaged, the positional relationship between the first connector 56 and the second connector 65 is substantially proper, but is not perfectly proper owing to shape variation of the rough guide 66. To absorb this misregistration, the first connector 56 is supported to move to some extent within the above-described gap between the first holder 55 and the first connector 56. Thus, even if some misregistration occurs, the first holder 55 moves and the first connector 56 can engage with the second connector 65. When the printer main body 300 is further lowered, as illustrated in FIGS. 11C and 11D, the positioning holes of the printer main body 300 engage with the positioning pins of the sheet feeding option 301. Then, the grounding legs 53 of the printer main body 300 are placed on the seat faces 62 of the sheet feeding option 301. Thus, connection of the first connector 56 of the printer main body 300 and the second connector 65 of the sheet feeding option 301 is completed. The position of the second connector 65 illustrated in FIG. 11D is referred to as a connected position where connection to the first connector 56 is completed. Since the printer main body 300 and the sheet feeding option 301 are engaged in a proper positional relationship in the X-, Y-, and Z-directions and are electrically connected, they are brought into a usable state. Disconnection (Removal) of Printer Main Body 300 and Sheet Feeding Option 301

Next, a description will be given of the user's operation of removing the printer main body 300 from the sheet feeding option 301 by lifting the printer main body 300 straight in the Z-direction (vertical direction). For part replacement or cleaning, the user removes the printer main body 300 from the sheet feeding option 301 by lifting the printer main body 300 while gripping the handles 107 of the printer main body 300. At this time, the user performs reverse operation to the above-described operation of lowering the printer main body 300 straight in the Z-direction and placing the printer main body 300 on the sheet feeding option 301. That is, when the user lifts the printer main body 300 from the state of FIGS. 11C and 11D while gripping the handles 107, the grounding legs 53 of the printer main body 300 separate from the seat faces 62 of the sheet feeding option 301. Then, the positioning pins of the sheet feeding option 301 disengage from the positioning holes of the printer main body 300. When the printer main body 300 is further lifted, as illustrated in FIGS. 10C and 10D, the first connector 56 of the printer main body 300 disengages from the second connector 65 of the sheet feeding option 301. At this time, since the rough guide 66 and the rough guide hole 57 are located higher than the connectors in the Z-direction, the engagement state thereof is maintained. For this reason, the first connector 56 is drawn straight in a J-direction serving as the axial direction of the rough guide 66. By being drawn straight, the first connector 56 is removed without breaking lead wires and reinforcing wall shapes (not illustrated) inside the second connector 65. When the printer main body 300 is further lifted, as illustrated in FIGS. 10A and 10B, the rough guide 66 of the sheet feeding option 301 is disengaged from the rough guide hole 57 of the printer main body 300, and the printer main body 300 and the sheet feeding option 301 are separated completely.

Oblique Removal of Printer Main Body 300 and Sheet Feeding Option 301

Figure 12A:
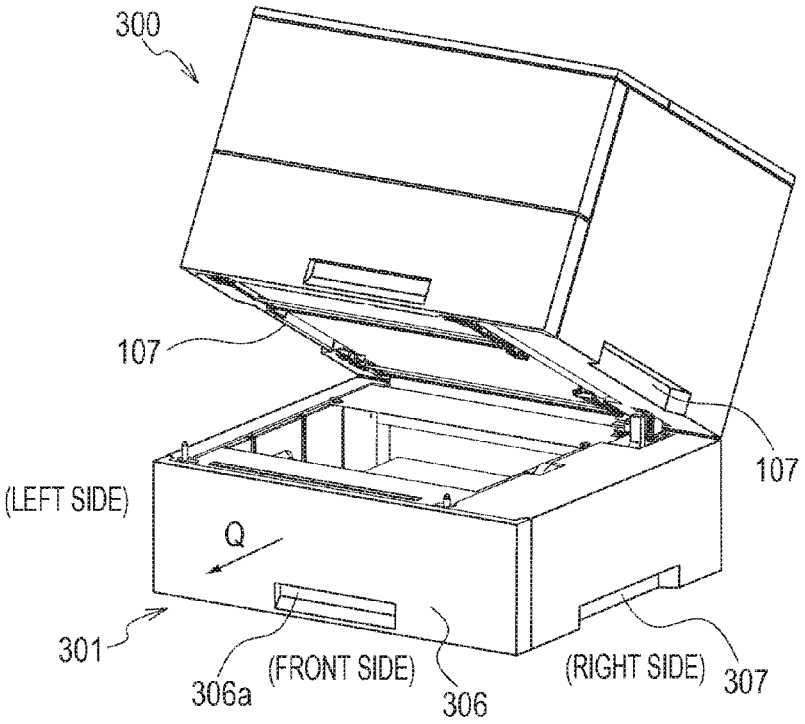
FIG. 12A is a schematic perspective view illustrating a state in which the printer main body is removed from the sheet feeding option in the first embodiment.
Figure 12B:
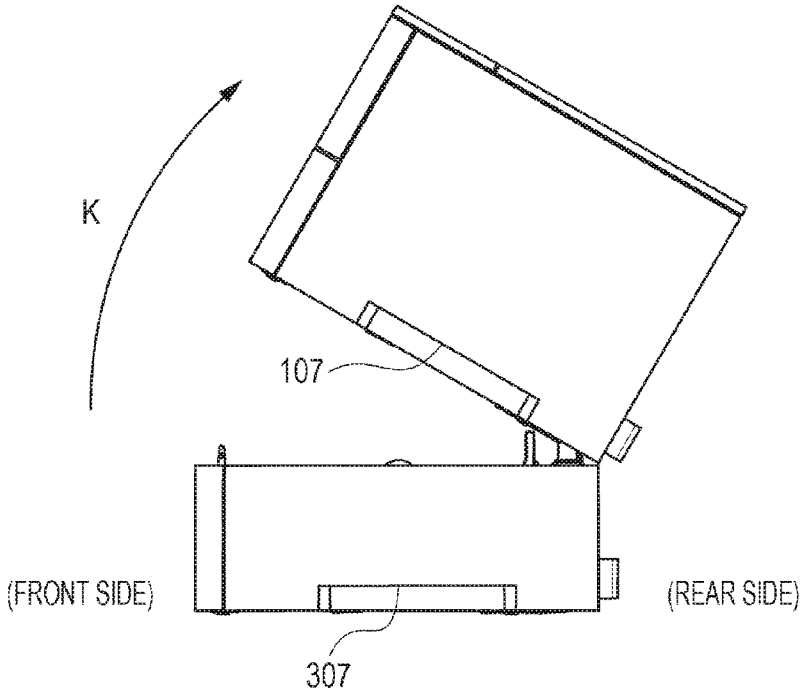
FIG. 12B is a schematic right side view illustrating the state in which the printer main body is removed from the sheet feeding option in the first embodiment.

Next, with reference to FIGS. 12A and 12B to 14A to 14D, a description will be given of the user's operation of removing the printer main body 300 by turning and tilting the printer main body 300 on a portion near a rear edge ridgeline in a K-direction (see FIG. 12B) and moving the printer main body 300 obliquely with respect to the vertical direction. FIGS. 12A, 13A, 13C, and 14A are perspective views, FIG. 12B is a right side view, and FIGS. 13B, 13D, and 14B are cross-sectional views of the section near the connectors.

The sheet feeding option 301 or the printer main body 300 is often removed in a tilted state when the center of gravity of the sheet feeding option 301 or the printer main body 300 exists on the rear side or when the removing operation is performed in a state in which the user stands on the rear side of the sheet feeding option 301 or the printer main body 300. The handles 107 to be gripped by the user to lift and support the printer main body 300 are disposed only on the left surface and the right surface (both end portions in the Y-direction) of the printer main body 300. For this reason, the user easily turns the printer main body 300 in the K-direction while carrying the printer main body 300. The handles 307 to be gripped to lift and support the sheet feeding option 301 are also disposed only on the left surface and the right surface of the sheet feeding option 301. For this reason, even when a plurality of sheet feeding options 301 are stacked, the user easily turns the sheet feeding options 301 in the K-direction while carrying the sheet feeding options 301.

Figure 13A:
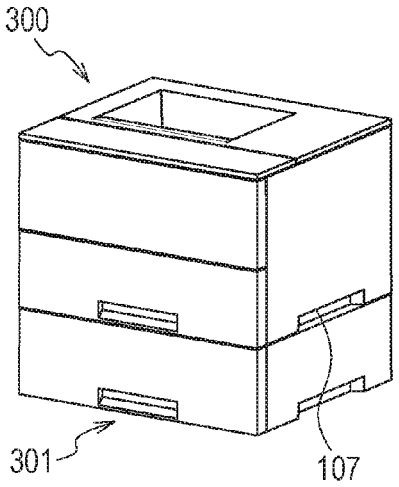
FIG. 13A is a schematic perspective view illustrating the relationship between the sheet feeding option and the printer main body of the first embodiment.
Figure 13B:
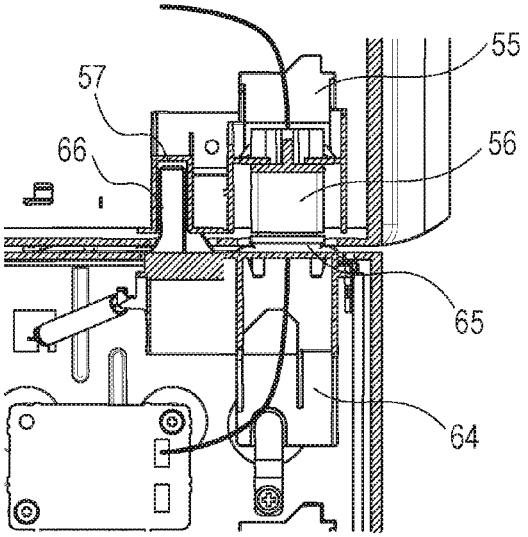
FIG. 13B is a schematic cross-sectional view of the drawer connecting members of the first embodiment.
Figure 13C:
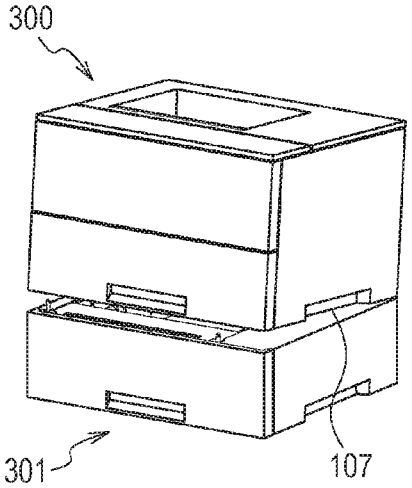
FIG. 13C is a schematic perspective view illustrating the relationship between the sheet feeding option and the printer main body of the first embodiment.
Figure 13D:
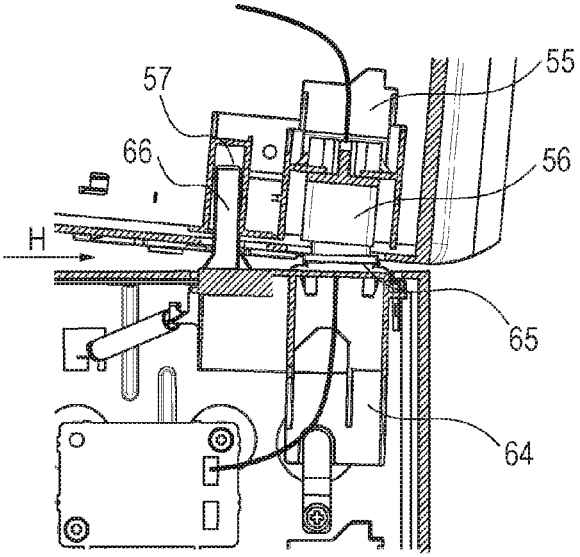
FIG. 13D is a schematic cross-sectional view of the drawer connecting members of the first embodiment.

FIG. 13A is a schematic perspective view illustrating a connection track of the apparatus when the user removes the printer main body 300 from the sheet feeding option 301 by obliquely tilting the printer main body 300, and FIG. 13B is a schematic cross-sectional view of the section near the drawer connecting member. When removing the sheet feeding option 301 from a proper connected state illustrated in FIGS. 13A and 13B, the user first starts tilting the printer main body 300 by using the portion near the rear edge ridgeline as the pivot axis. Then, as illustrated in FIGS. 13C and 13D, the grounding legs 53 of the printer main body 300 separate from the seat faces 62 of the sheet feeding option 301, and the positioning pins of the sheet feeding option 301 disengage from the positioning holes of the printer main body 300. At the same time, the printer main body 300 takes an oblique posture. Hence, the first holder 55 and the rough guide hole 57 fixed to the printer main body 300 also take an oblique posture. When the rough guide hole 57 takes the oblique posture, the rough guide 66 fitted in the rough guide hole 57 touches the rough guide hole 57 and receives force in the H-direction. Hence, the second holder 64 turns on the pivot center portion 69. Hence, the second holder 64 also takes an oblique posture to maintain the fitting state of the rough guide 66 in the rough guide hole 57. That is, the second connector 65 is turned by a predetermined turn amount toward the rear side (one end) of the sheet feeding option 301 from the connected position where connection to the first connector 56 is completed.

In the X-direction, the rough guide 66 is disposed farther from the rear side of the sheet feeding option 301 than the second connector 65. However, since the upper surface 66*a* of the rough guide 66 is located higher than the upper surface 65*a* of the second connector 65 in the Z-direction, even when the printer main body 300 tilts rearward, the rough guide 66 can touch the rough guide hole 57 to receive the force in the H-direction.

Figure 14A:
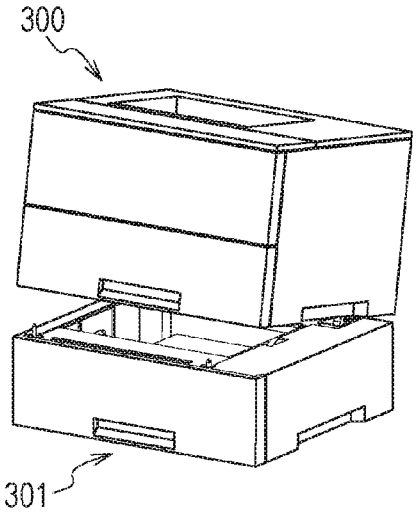
FIG. 14A is a schematic perspective view illustrating the relationship between the sheet feeding option and the printer main body of the first embodiment.
Figure 14B:
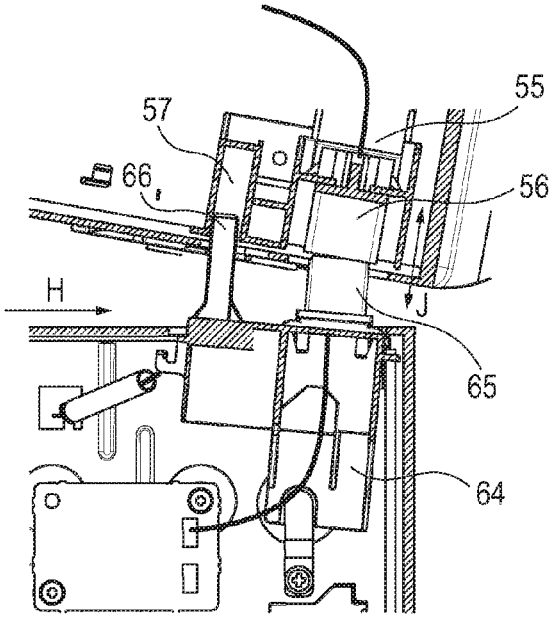
FIG. 14B is a schematic cross-sectional view of the drawer connecting members of the first embodiment.
Figure 14C:
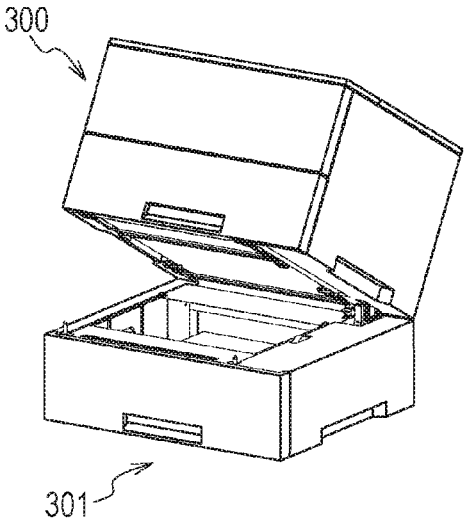
FIG. 14C is a schematic perspective view illustrating the relationship between the sheet feeding option and the printer main body of the first embodiment.
Figure 14D:
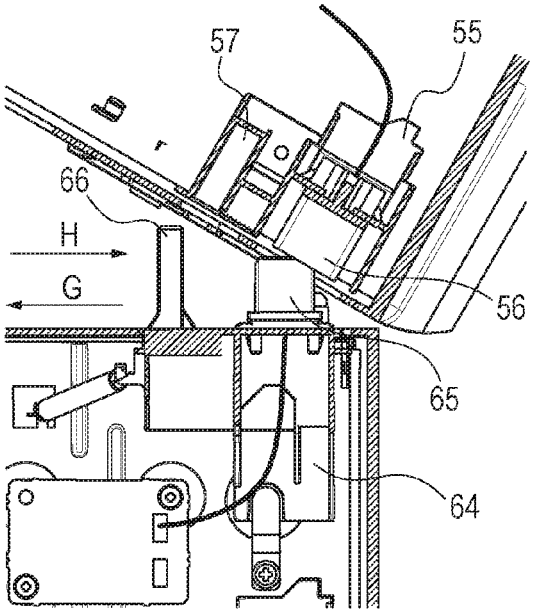
FIG. 14D is a schematic cross-sectional view of the drawer connecting members of the first embodiment.

When the printer main body 300 is further tilted, as illustrated in FIGS. 14A and 14B, the first connector 56 of the printer main body 300 disengages from the second connector 65 of the sheet feeding option 301. At this time, the rough guide 66 and the rough guide hole 57 are still fitted, and the second holder 64 and the first holder 55 maintain their oblique postures to be parallel to each other. For this reason, the second connector 65 becomes substantially straight (substantially parallel) with respect to a J-direction in which the first connector 56 moves. Hence, similarly to the case in which the printer main body 300 is lifted straight and removed, as illustrated in FIGS. 12A and 12B, the printer main body 300 is removed without breaking the lead wires and reinforcing wall shapes (not illustrated) inside the second connector 65. When the printer main body 300 is further tilted, as illustrated in FIGS. 14C and 14D, the rough guide 66 of the sheet feeding option 301 disengages from, the guide hole 57 of the printer main body 300. At this time, the force in the H-direction applied to the rough guide 66 is removed, and the second holder 64 is biased in the G-direction by the spring 67 and returns to the position of FIGS. 7A and 7B where the abutting portion 70 abuts on the second restricting portion 73. Since the rough guide 66 and the rough guide hole 57 are disengaged, the printer main body 300 and the sheet feeding option 301 are completely separated.

At this time, the second connector 65 returns to the same position as the connected position where connection to the first connector 56 is completed (see FIG. 11D). Here, the turn amount by which the second connector 65 can turn from the connected position where connection to the first connector 56 is completed (see FIG. 11D) to the front side (the other end) of the sheet feeding option 301 is taken as R1. The turn amount by which the second connector 65 can turn from, the connected position where connection to the first connector 56 is completed (see FIG. 11D) to the rear side (one end) of the sheet feeding option 301 is taken as R2. In the first embodiment, the position of the second restricting portion 73 is set so that R1 is 0. For this reason, R2 is more than R1. Thus, the second connector 65 and the first connector 56 can be prevented from, being broken when the printer main body 300 is tilted and removed rearward. In contrast, when the printer main body 300 is removed by being tilted frontward, it is tilted by using the portion near the front edge ridgeline as the turn axis. However, the second connector 65 is located farther from the front side of the sheet feeding option 301 than the rear side. For this reason, the second connector 65 and the first connector 56 can be prevented from being broken even when the second connector 65 is not tilted frontward so much. Thus, when R2 is set to be more than R1, as described above, it is unnecessary to ensure, inside the sheet feeding option 301, undue space where the second connector 65 turns. This can reduce the size of the interior of the sheet feeding option 301.

Connections and Disconnection of Plural Sheet Feeding Options 301

A description will be given of operations of connecting and disconnecting a plurality of sheet feeding options 301.

Figure 2:
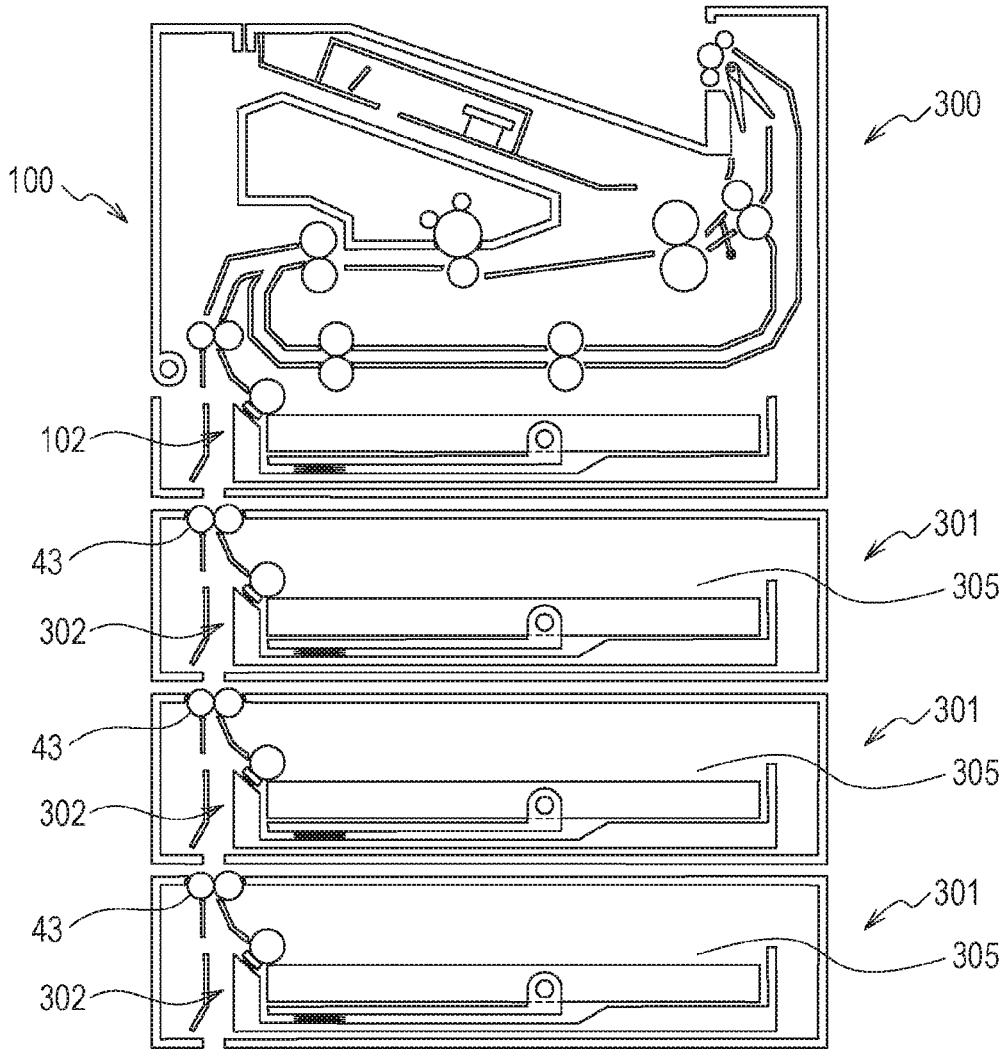
FIG. 2 is a schematic cross-sectional view illustrating a connected state of sheet feeding options and a printer main body in the first embodiment.

When a plurality of sheet feeding options 301 are used, a sheet feeding option 301 is placed on another sheet feeding option 301, and the printer main body 300 is placed on the upper sheet feeding options 301, as illustrated in FIG. 2. As described above, the lower surface of each sheet feeding option 301 is provided with the first positioning hole 50, the second positioning hole 51, the third positioning hole 52, the plural grounding legs 53, and the first connecting member 54 similarly to those of the printer main body 300. For this reason, the second connecting member 63 and the first connecting member 54 perform the same operations when the printer main body 300 is placed on the sheet feeding option 301 and when a sheet feeding option 301 is placed on another sheet feeding option 301. Therefore, when a sheet feeding option 301 is placed on another sheet feeding option 301, the same operations as those of FIGS. 10A to 10D to 13A to 13D are performed.

Similarly, the operations of the second connecting member 63 and the first connecting member 54 are the same when the printer main body 300 is removed from the sheet feeding option 301 and when the sheet feeding option 301 is removed from another sheet feeding option 301. Therefore, the operations of removing the sheet feeding option 301 from the sheet feeding option 301 are the same as those of FIGS. 13A to 13D to 18A and 18B. Thus, even when the sheet feeding option 301 is tilted and obliquely removed from another sheet feeding option 301, the second connector 65 and the first connector 56 are not broken.

As described above, in the first embodiment, when the user obliquely removes the printer main body 300 from the sheet feeding option 301 while tilting the printer main body 300, since the rough guide 66 touches the rough guide hole 57, the second holder 64 and the second connector 65 take oblique postures. For this reason, the second connector 65 becomes substantially straight (moves substantially parallel) with respect to the moving direction of the first connector 56 fixed to the printer main body 300. Hence, even when the printer main body 300 is tilted and obliquely removed, breakage of the second connector 65 and the first connector 56 can be prevented. In the case in which a plurality of sheet feeding options 301 are used, when one sheet feeding option 301 is removed from the other sheet feeding option 301, effects similar to the above can be provided. That is, even when the one sheet feeding option 301 is tilted and obliquely removed from the other sheet feeding option 301, breakage of the second connector 65 and the first connector 56 can be prevented.

Second Embodiment

A second embodiment of the present invention will be described below. The basic configuration of an image forming apparatus 100 according to the second embodiment of the present invention is similar to that adopted in the first embodiment. The basic structure of a sheet feeding option 303 of the second embodiment is also similar to that of the sheet feeding option 301 of the first embodiment. For this reason, elements having functions and structures identical or corresponding to those of the first embodiment are denoted by the same reference numerals, and detailed descriptions thereof are skipped. In the second embodiment, a description will be given of a structure for preventing breakage of a second connector 65 and a first connector 56, for example, when the widths of a printer main body 300 and a sheet feeding option 303 in the front-rear direction (X-direction) are relatively short. That is, in the case in which the widths of the printer main body 300 and the sheet feeding option 303 in the front-rear direction are relatively short, the second connector 65 needs to be positively turned frontward when the printer main body 300 is tilted frontward and removed by using a portion near a front edge ridgeline as a turn axis.

Figure 15A:
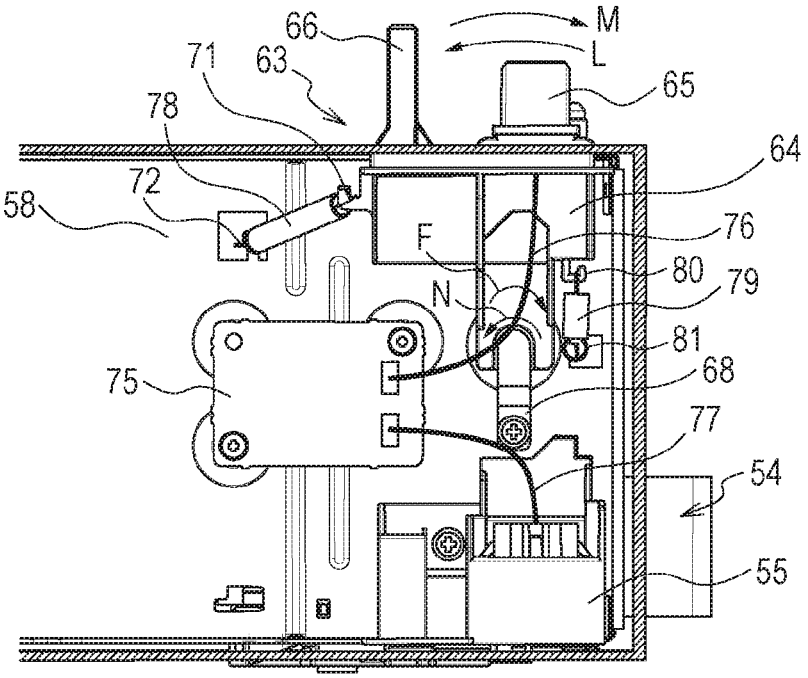
FIG. 15A is a schematic cross-sectional view of a second drawer connecting member according to a second embodiment.
Figure 15B:
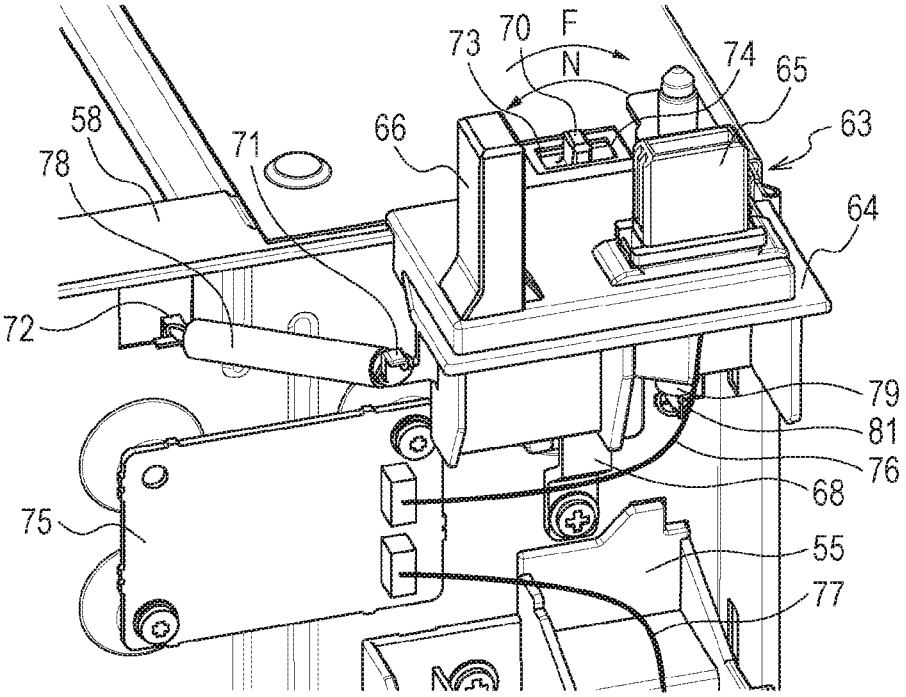
FIG. 15B is a schematic perspective view of the second drawer connecting member of the second embodiment.

First, the sheet feeding option 303 provided in the image forming apparatus 100 of the second embodiment will be described with reference to FIGS. 15A, 15B, 16A and 16B. FIGS. 15A and 15B are a schematic cross-sectional view and a schematic perspective view, respectively, of a section near a second connecting member 63 and a first connecting member 54 in the sheet feeding option 303. As illustrated in FIGS. 15A and 15B, the second connecting member 63 of the sheet feeding option 303 includes a second connector 65, a second holder 64, a bias spring-A 78, a bias spring-B 79, and a pressing member 68. The second holder 64 is supported while being held between a frame 58 and the pressing member 68, similarly to the first embodiment, and a pivot center portion 69 thereof is fitted in the frame 58. Hence, the second holder 64 can pivot in an F-direction and an N-direction. The bias spring-A 78 is attached at one end to a spring hook portion 71 of the second holder 64 and is attached at the other end to a spring hook portion 72 of the frame 58 of the sheet feeding option 303. The bias spring-B 79 is attached at one end to a spring hook portion B80 of the second holder 64 and is attached at the other end to a spring hook portion B81 of the frame 58 of the sheet feeding option 303. Therefore, a moment L in the N-direction is generated by compressive force of the bias spring-A 78, and a moment M in the F-direction is generated by compressive force of the bias spring-B 79. Thus, the second holder 64 remains stationary at a position where the moment L and the moment M balance each other. At this time, an abutting portion 70 of the second holder 64 is out of contact with a second restricting portion 73 and a first restricting portion 74.

Figure 16A:
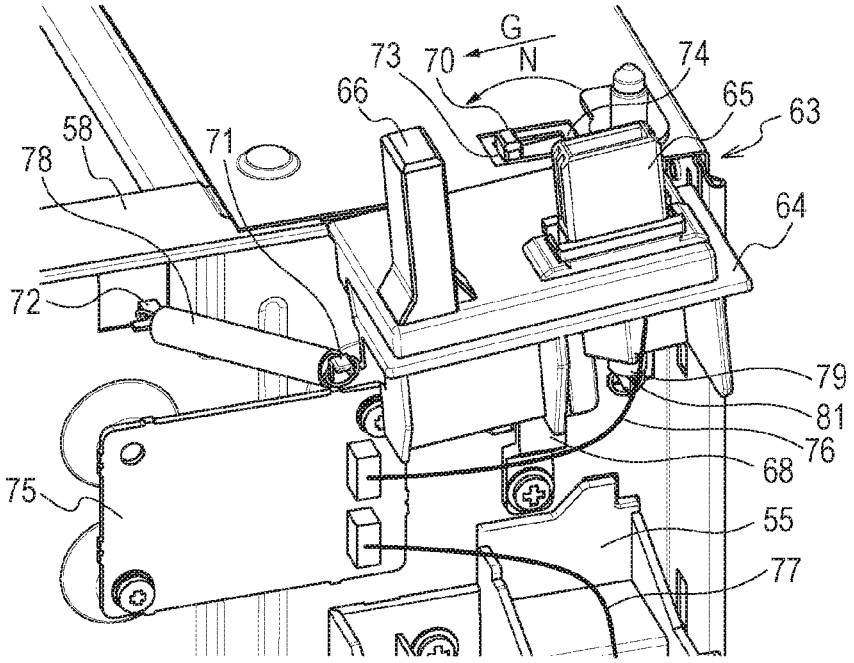
FIGS. 16A and 16B are schematic perspective views of the second drawer connecting member of the second embodiment.
Figure 16B:
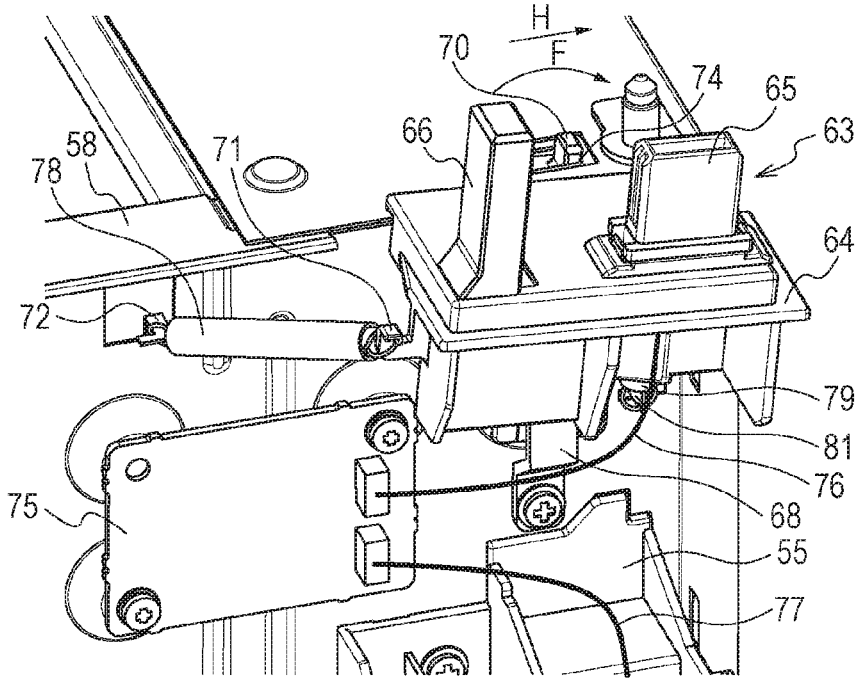

FIGS. 16A and 16B are schematic perspective views illustrating a state in which the second holder 64 is pivoted. When force in the G-direction is applied to the second holder 64, as illustrated in FIG. 16A, the second holder 64 can pivot in the N-direction on the axis of the pivot center portion 69 until the abutting portion 70 abuts on the second restricting portion 73. When force in the H-direction is applied to the second holder 64, as illustrated in FIG. 16B, the second holder 64 can pivot in the F-direction on the axis of the pivot center portion 69 until the abutting portion 70 abuts on the first restricting portion 74. When the applied force is removed, the second holder 64 returns and stops at the position where the moment L and the moment M balance each other, as illustrated in FIG. 15B.

Next, operations of the second connecting member 63 for connecting and disconnecting the printer main body 300 and the sheet feeding option 303 will be described with reference to FIGS. 17A, 17B, 18A, and 18B.

In the second embodiment, the operation of the second connecting member 63 performed when the user lowers the printer main body 300 straight in the Z-direction and places the printer main body 300 onto the sheet feeding option 303 is similar to that adopted in the first embodiment. Further, the operation of the second connecting member 63 performed when the user lifts the printer main body 300 straight in the Z-direction and removing the printer main body 300 from the sheet feeding option 301 is also similar to that adopted in the first embodiment. Hence, descriptions of these two operations are skipped.

Figure 17A:
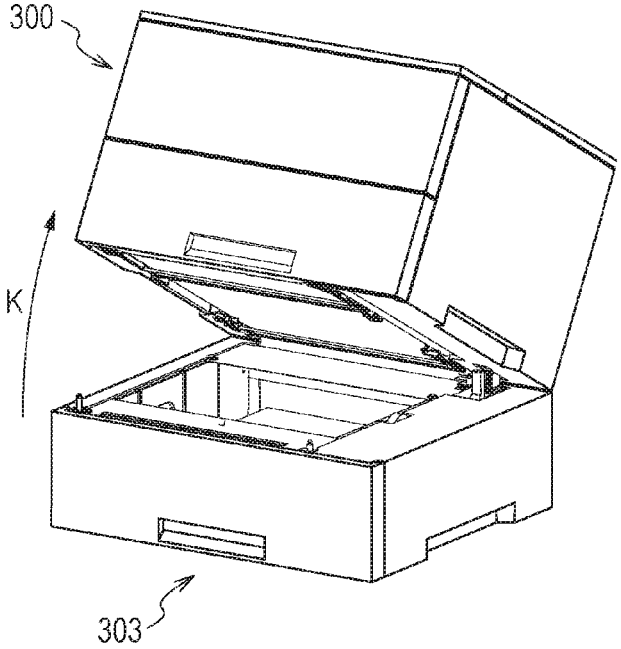
FIG. 17A is a schematic perspective view illustrating the relationship between a sheet feeding option and a printer main body according to the second embodiment.
Figure 17B:
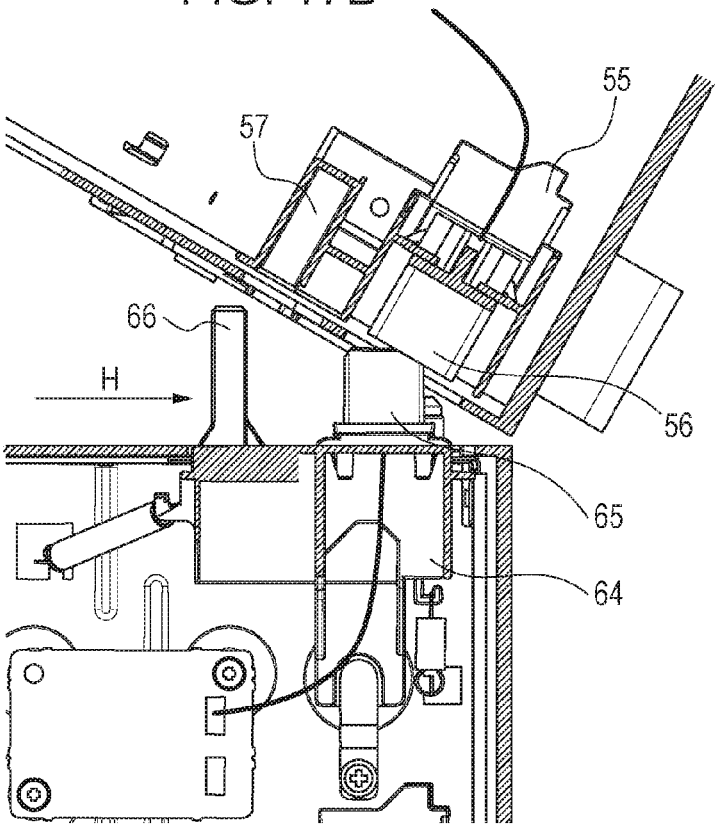
FIG. 17B is a schematic cross-sectional view of the drawer connecting members of the second embodiment.

Next, with reference to FIGS. 17A and 17B, a description will be given of the user's operation of turning the printer main body 300 in the K-direction on a portion near a rear edge ridgeline of the printer main body 300 and tilting and obliquely removing the printer main body 300 in the second embodiment. FIGS. 17A and 17B are a schematic perspective view and a schematic cross-sectional view, respectively, illustrating the user's operation of turning the printer main body 300 in the K-direction on the portion near the rear edge ridgeline of the printer main body 300 and tilting and obliquely removing the printer main body 300 when lifting the printer main body 300. At this time, the second holder 64 pivots, the second connector 65 is disengaged straight, and the rough guide 66 is then disengaged from the rough guide hole 57. These series of operations are similar to those of the first embodiment. When the rough guide 66 is disengaged from the rough guide hole 57, the force in the H-direction received by the rough guide 66 of the second holder 64 is removed. Then, the second holder 64 stops at the position where the moment L and the moment M of the bias spring-A 78 and the bias spring-B 79 balance each other. Further, since the rough guide 66 and the rough guide hole 57 are disengaged, the printer main body 300 and the sheet feeding option 301 are separated completely.

Figure 18B:
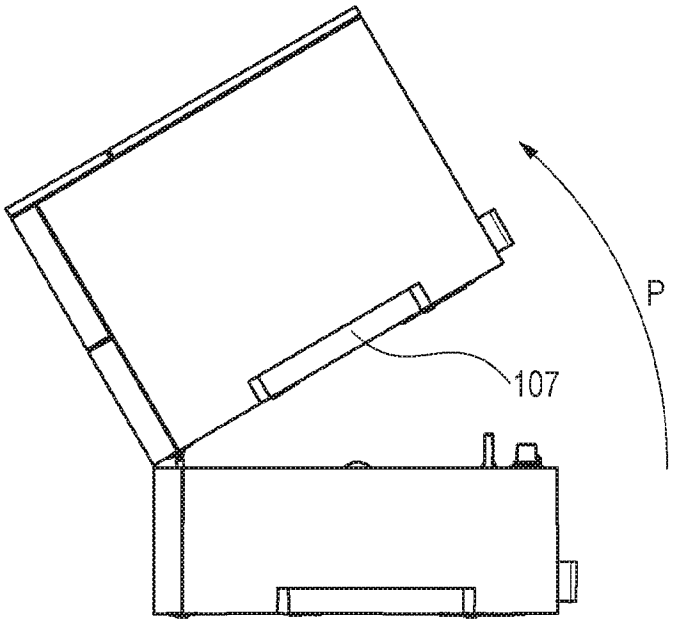
FIG. 18B is a schematic right side view illustrating the state in which the printer main body is removed from the sheet feeding option in the second embodiment.
Figure 18A:
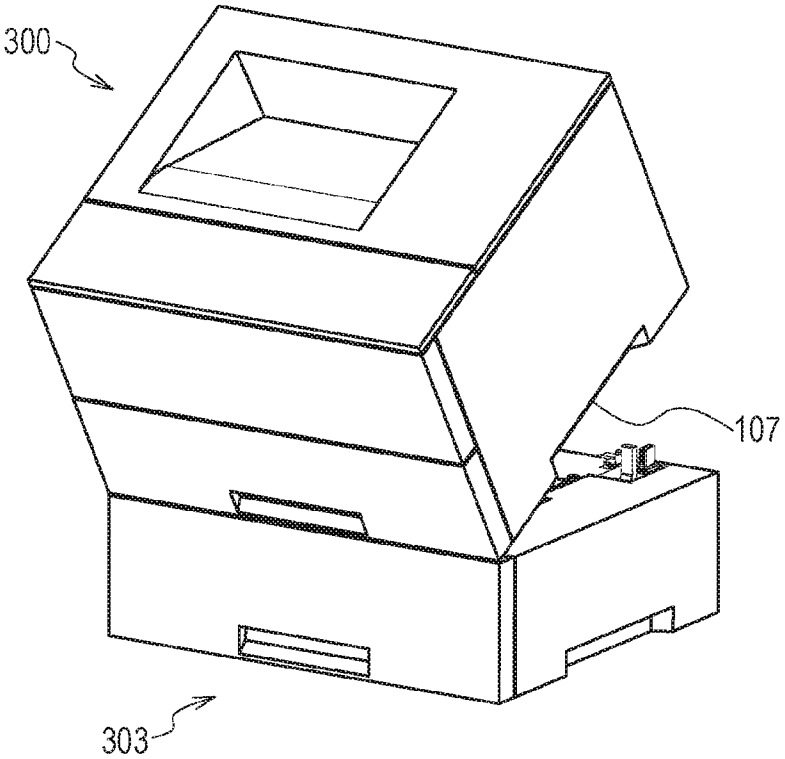
FIG. 18A is a schematic perspective view illustrating a state in which the printer main body is removed from the sheet feeding option in the second embodiment.

Next, a description will be given of the user's operation of tilting and obliquely removing the printer main body 300 while turning the printer main body 300 in the P-direction by using the portion near the front edge ridgeline of the printer main body 300 as the turn axis, as illustrated in FIGS. 18A and 18B.

Figure 19A:
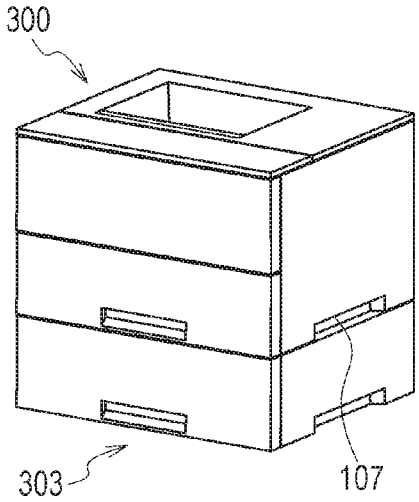
FIG. 19A is a schematic perspective view illustrating the relationship between the sheet feeding option and the printer main body of the second embodiment.
Figure 19B:
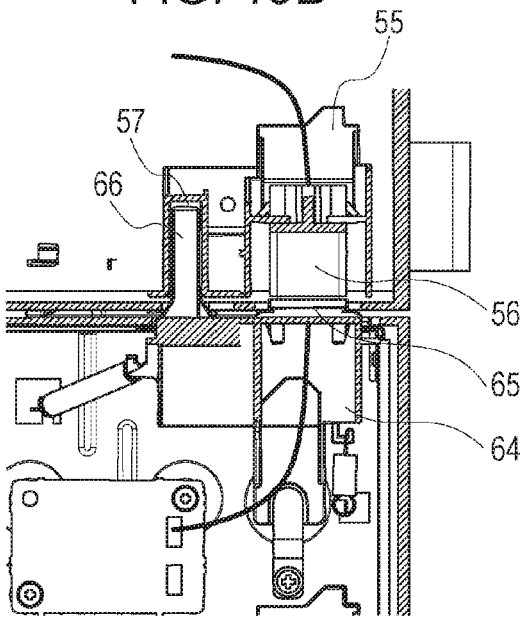
FIG. 19B is a schematic cross-sectional view of the drawer connecting members of the second embodiment.
Figure 19C:
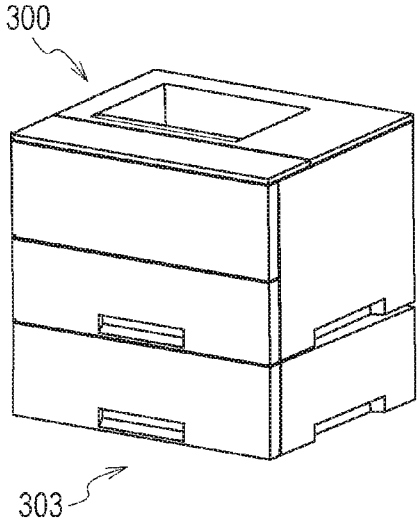
FIG. 19C is a schematic perspective view illustrating the relationship between the sheet feeding option and the printer main body of the second embodiment.
Figure 19D:
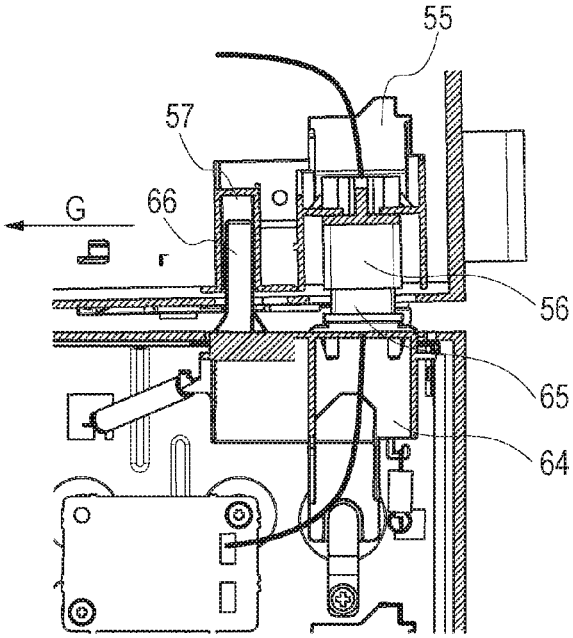
FIG. 19D is a schematic cross-sectional view of the drawer connecting members of the second embodiment.
Figure 20A:
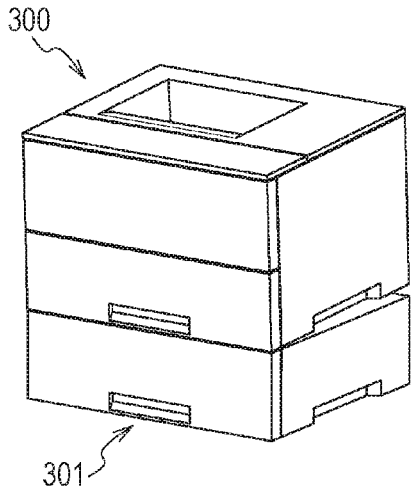
FIG. 20A is a schematic perspective view illustrating the relationship between the sheet feeding option and the printer main body of the second embodiment.
Figure 20B:
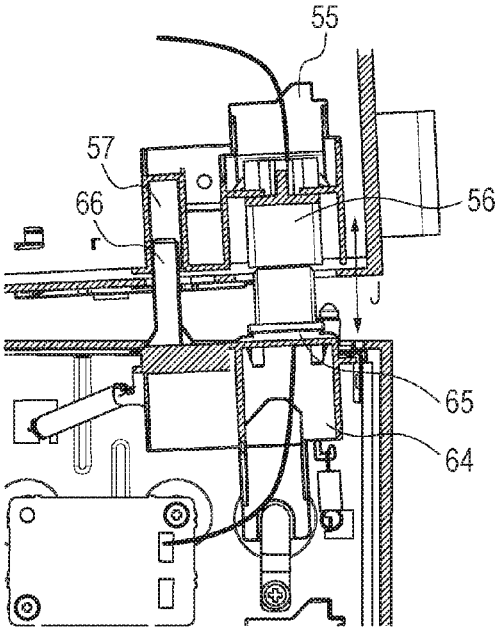
FIG. 20B is a schematic cross-sectional view of the drawer connecting members of the second embodiment.
Figure 20C:
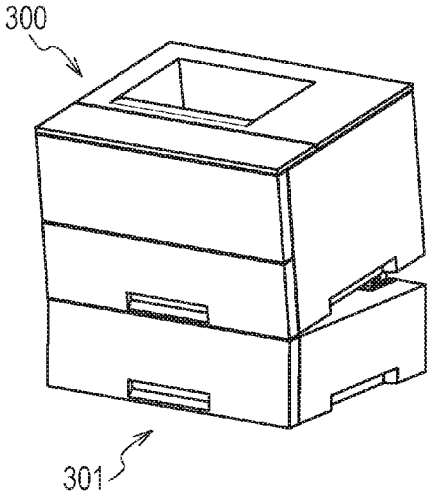
FIG. 20C is a schematic perspective view illustrating the relationship between the sheet feeding option and the printer main body of the second embodiment.
Figure 20D:
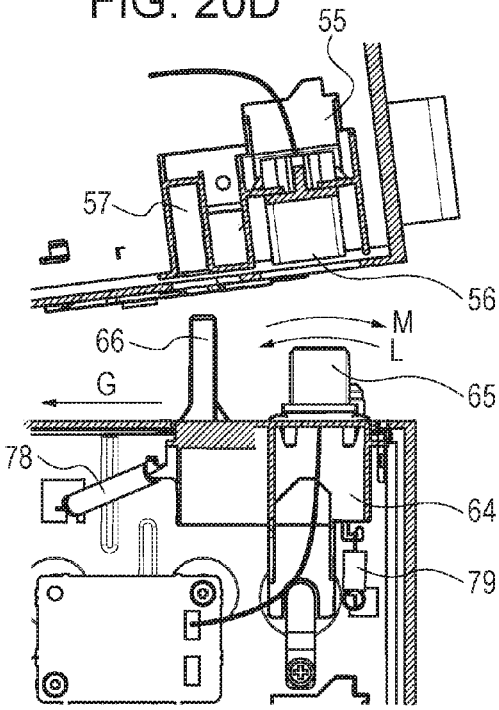
FIG. 20D is a schematic cross-sectional view of the drawer connecting members of the second embodiment.

FIG. 19A is a schematic perspective view illustrating the connection track of the apparatus when the user obliquely tilts and removes the printer main body 300 from the sheet feeding option 303, and FIG. 19B is a schematic cross-sectional view of a section near the drawer connecting member. First, to remove the sheet feeding option 303 from the proper connected state illustrated in FIGS. 19A and 19B, the user grips handles 107 and starts tilting the printer main body 300 by using the front edge ridgeline as the turn axis. Then, as illustrated in FIGS. 19C and 19D, grounding legs 53 of the printer main body 300 separate from seat faces 62 of the sheet feeding option 303, and positioning pins of the sheet feeding option 303 are disengaged from positioning holes of the printer main body 300. Since the printer main body 300 takes an oblique posture at the same time, the first holder 55 and the rough guide hole 57 fixed to the printer main body 300 also take oblique postures. When the rough guide hole 57 takes the oblique posture, since the rough guide 66 engaged with the rough guide hole 57 receives a force in the G-direction, the second holder 64 having the rough guide 66 pivots on the pivot center portion 69. Hence, the second holder 64 also takes an oblique posture to maintain engagement with the rough guide hole 57. When the printer main body 300 is further tilted, as illustrated in FIGS. 20A and 20B, the first connector 56 of the printer main body 300 disengages from the second connector 65 of the sheet feeding option 303. Since the rough guide 66 and the rough guide hole 57 are still engaged and the second holder 64 and the first holder 55 maintain their oblique postures at this time, the first connector 56 is drawn straight in the J-direction. Hence, similarly to the case in which the printer main body 300 is lifted straight and removed in the Z-direction, the first connector 56 is detached without breaking lead wires and reinforcing wall shapes (not illustrated) inside the second connector 65. When the printer main body 300 is further tilted, as illustrated in FIGS. 20C and 20D, the rough guide 66 of the sheet feeding option 303 disengages from the rough guide hole 57 of the printer main body 300. At this time, the force in the G-direction applied to the rough guide 66 of the second holder 64 is removed, and the second holder 64 stops at the position where the moment L and the moment M of the bias spring-A 78 and the bias spring-B 79 balance each other. Since the rough guide 66 and the rough guide hole 57 are also disengaged, the printer main body 300 and the sheet feeding option 303 are separated completely. Here, the turn amount, by which the second connector 65 can turn from a connected position where connection to the first connector 56 is completed (see FIG. 19B) to the front side (the other end) of the sheet feeding option 301 is taken as R1. The turn amount by which the second connector 65 can turn from the connected position where connection to the first connector 56 is completed (see FIG. 19B) to the rear side (one end) of the sheet feeding option 301 is taken as R2. In the second embodiment, since the second connector 65 is also located at the position farther from the front side of the sheet feeding option 303 than the rear side, the positions of the first restricting portion 74 and the second restricting portion 73 are set so that R2 is more than R1. According to this, it is unnecessary to ensure, inside the sheet feeding option 303, undue space where the second connector 65 turns. This can reduce the size of the interior of the sheet feeding option 303.

In the second embodiment, the operation of the second connecting member 63 is also the same when the printer main body 300 is removed from the sheet feeding option 303 and when one sheet feeding option 303 is removed from another sheet feeding option 303. Hence, similarly to the first embodiment, similar effects can be obtained even when the one sheet feeding option 303 is removed from another sheet feeding option 303.

As described above, in the second embodiment, even when the user obliquely removes the printer main body 300 from the sheet feeding option 301 while tilting the printer main body 300 by using the portion near the rear edge ridgeline of the printer main body 300 as the turn axis, the second connector 65 and the first connector 56 can be prevented from breakage. Further, in the second embodiment, even when the user obliquely removes the printer main body 300 from the sheet feeding option 301 while tilting the printer main body 300 by using the portion near the front edge ridgeline of the printer main body 300 as the turn axis, the second connector 65 and the first connector 56 can be prevented from breakage.

The connection structure between the image forming apparatus and the sheet feeding option in the first and second embodiments described above may be applied to the connection structure between the image forming apparatus and an external unit other than the sheet feeding option. Further, the connection structure between the image forming apparatus and the sheet feeding option in the first and second embodiments described above may be applied to the connection structure between a plurality of sheet feeding options or between external units other than the sheet feeding option.

Other Embodiments

Figure 21:
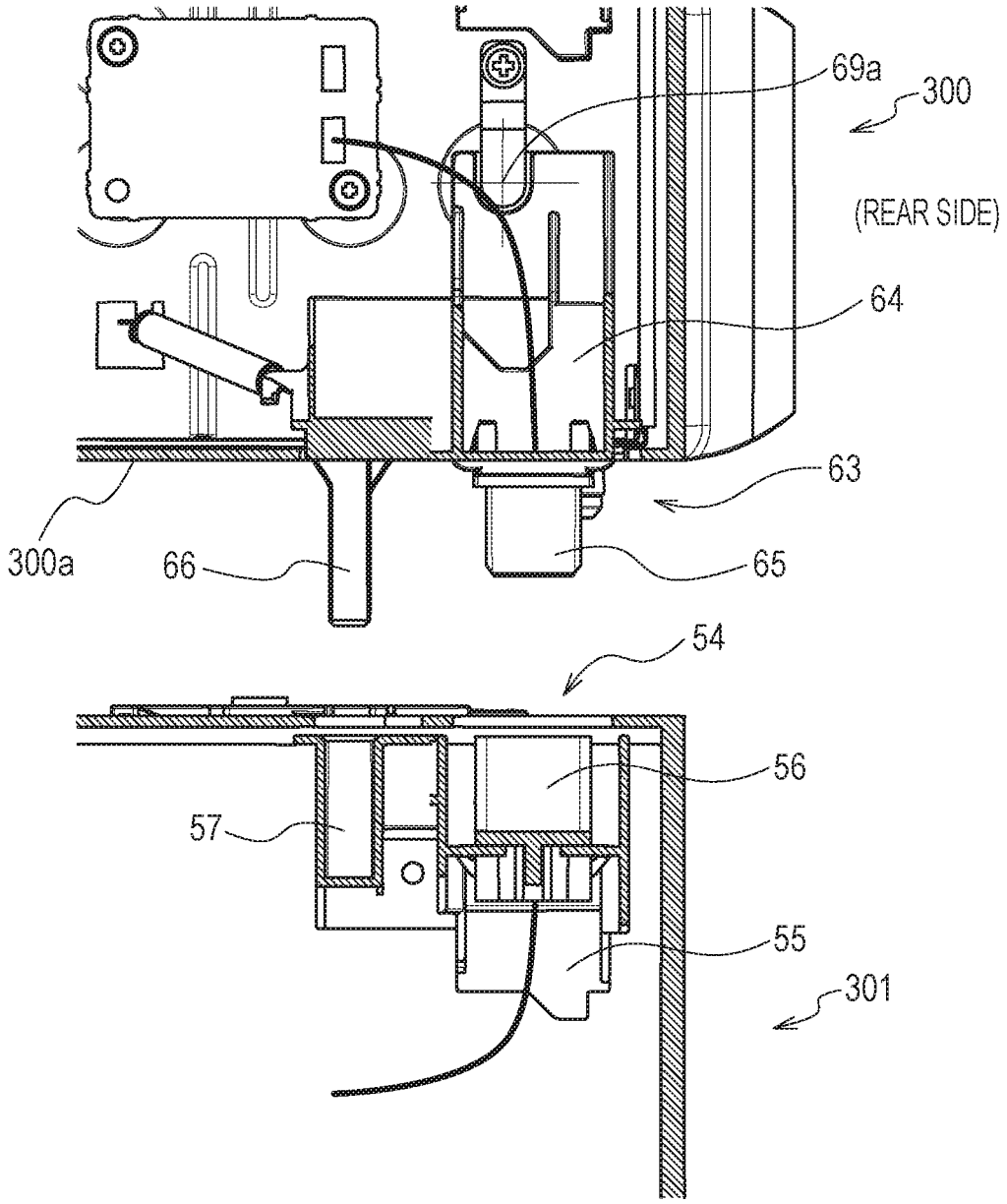
FIG. 21 is a schematic cross-sectional view of drawer connecting members according to another embodiment.

While the connecting part (second connecting member 63) provided in the lower device pivots in the connection structure of the first and second embodiments, the pivotal connecting part may be provided in the upper device. That, is, the connecting part provided in the upper device may pivot, similarly to the first and second embodiments. FIG. 21 illustrates an example of such a structure. In FIG. 21, an upper printer main body 300 is provided with a second connector 65 and a rough guide 66 projecting downward, and integrally pivots on a pivot axis 69*a*. The rough guide 66 is disposed at a position farther from a rear end portion of a lower part 300*a* of the printer main body 300 than the second connector 65. A lower sheet feeding option 301 is provided with a first connecting member 54 including a first holder 55, a first connector 56, and a rough guide hole 57. This structure can also obtain effects similar to those of the first and second embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-093500, filed Apr. 30, 2015, which is hereby incorporated by reference herein in its entirety.

What is claimed is:

1. A connection device on or under which an electric apparatus is mounted and which is electrically connected to the mounted electric apparatus, the connection device comprising:

a connecting member provided turnably on a pivot axis and having a projecting shape that fits in the electric apparatus, the connecting member being electrically connected to the electric apparatus when fitting in the electric apparatus, wherein the connecting member is disposed at a position closer to one end than the other end of the connection device in a direction intersecting a direction of the pivot axis, and turns only toward the one end, and wherein an axis of a projecting direction of the projecting shape tilts to be closer to the one end when the connecting member turns on the pivot axis toward the one end.

2. The connection device according to claim 1, further comprising:

a handle provided in each end portion of the electric apparatus in the direction of the pivot axis so that the electric apparatus is supported at a position higher than the connection device.

3. The connection device according to claim 1, wherein the connecting member has a second connector to be connected to a first connector provided in the electric apparatus.

4. The connection device according to claim 3, wherein the connecting member includes the second connector and a holder configured to hold the second connector, and the holder turns on the pivot axis.

5. The connection device according to claim 4, wherein the electric apparatus is mounted on the connection device, wherein the holder has a projection protruding upward from the second connector, and wherein the projection touches the electric apparatus when the electric apparatus is mounted on or removed from the connection device.

6. The connection device according to claim 5, wherein the projection is disposed at a position farther from the one end of the connection device than the second connector in the direction intersecting the direction of the pivot axis.

7. The connection device according to claim 1, further comprising:

a feeding unit configured to feed a recording material to the electric apparatus so that an image is formed on the recording material by the electric apparatus.

8. A connection device on or under which an electric apparatus is mounted and which is electrically connected to the mounted electric apparatus, the connection device comprising:

a connecting member provided turnably on a pivot axis, wherein the connecting member has a projecting shape that fits in the electric apparatus, and the connecting member is electrically connected to the electric apparatus when fitting in the electric apparatus, wherein the connecting member is disposed at a position closer to one end than the other end of the connection device in a direction intersecting a direction of the pivot axis, and a turn amount by which the connecting member turns from a connected position electrically connected to the electric apparatus toward the one end is more than a turn amount by which the connecting member turns from the connected position toward the other end, and wherein an axis of a projecting direction of the projecting shape gets closer to the one end or the other end, when the connecting member turns on the pivot axis.

9. The connection device according to claim 8, further comprising:

a handle provided in each end portion of the electric apparatus in the direction of the pivot axis so that the electric apparatus is supported at a position higher than the connection device.

10. The connection device according to claim 9, wherein the connecting member has a second connector to be connected to a first connector provided in the electric apparatus.

11. The connection device according to claim 10, wherein the connecting member includes the second connector and a holder configured to hold the second connector, and the holder turns on the pivot axis.

12. The connection device according to claim 11, wherein the electric apparatus is mounted on the connection device, wherein the holder has a projection protruding upward from the second connector, and wherein the projection touches the electric apparatus when the electric apparatus is mounted on or removed from the connection device.

13. The connection device according to claim 12, wherein the projection is disposed at a position farther from the one end of the connection device than the second connector in the direction intersecting the direction of the pivot axis.

14. The connection device according to claim 8, further comprising:

a feeding unit configured to feed a recording material to the electric apparatus so that an image is formed on the recording material by the electric apparatus.

15. A connection device on or under which an electric apparatus is mounted and which is electrically connected to the mounted electric apparatus, the connection device comprising:

a connecting member provided turnably on a pivot axis and having a projecting shape that fits in the electric apparatus, the connecting member being electrically connected to the electric apparatus when fitting in the electric apparatus, wherein the connecting member is disposed at a position closer to one end than the other end of the connection device in a direction intersecting a direction of the pivot axis, and turns toward the one end, and wherein an axis of a projecting direction of the projecting shape tilts to be closer to the one end, when the connecting member turns on the pivot axis toward the one end.

* * * * *